US011289014B2

(12) United States Patent
Choi

(10) Patent No.: US 11,289,014 B2
(45) Date of Patent: Mar. 29, 2022

(54) DISPLAY DEVICE, DRIVING CIRCUIT, AND DRIVING METHOD

(71) Applicant: LG Display Co., Ltd., Seoul (KR)

(72) Inventor: WooSeok Choi, Seoul (KR)

(73) Assignee: LG DISPLAY CO., LTD, Seoul (KR)

( * ) Notice: Subject to any disclaimer, the term of this patent is extended or adjusted under 35 U.S.C. 154(b) by 0 days.

(21) Appl. No.: 17/124,379

(22) Filed: Dec. 16, 2020

(65) Prior Publication Data

US 2021/0193028 A1 Jun. 24, 2021

(30) Foreign Application Priority Data

Dec. 20, 2019 (KR) ..... 10-2019-0172402

(51) Int. Cl.
*G09G 3/32* (2016.01)

(52) U.S. Cl.
CPC ..... *G09G 3/32* (2013.01); *G09G 2300/0439* (2013.01); *G09G 2310/0278* (2013.01)

(58) Field of Classification Search
CPC ..... G09G 2310/0278; G09G 3/32; G09G 2300/0439
See application file for complete search history.

(56) References Cited

U.S. PATENT DOCUMENTS 7,348,942 B2 * 3/2008 Jo ..... G09G 3/325 345/76
2013/0271436 A1 * 10/2013 Shiomi ..... G09G 3/36 345/204
2018/0182287 A1 * 6/2018 Park ..... G09G 3/3233

* cited by examiner

*Primary Examiner* — Muhammad N Edun
(74) *Attorney, Agent, or Firm* — Polsinelli PC

(57) ABSTRACT

A display device, a driving circuit, and a driving method, and there are provided a structure and a driving circuit allowing overlap driving for improving a charging rate and fake data insertion driving, in which a fake image is inserted between real images to prevent afterimages and improve moving picture response time, to be simultaneously performed, thereby making it easier to implement high resolution.

20 Claims, 17 Drawing Sheets

DISPLAY DEVICE, DRIVING CIRCUIT, AND DRIVING METHOD

CROSS-REFERENCE TO RELATED APPLICATION

This application claims priority from Korean Patent Application No. 10-2019-0172402, filed on Dec. 20, 2019, which is hereby incorporated by reference in its entirety.

BACKGROUND

Field of the Disclosure

The present disclosure relates to a display device, a driving circuit, and a driving method.

Description of the Background

As the information society develops, demands for display devices for displaying images are increasing in various forms, and accordingly, various forms of display devices such as a liquid crystal display device, an organic light-emitting display device, a quantum dot display device, and the like are being developed.

Such display devices may perform display driving by charging a capacitor disposed in each of a plurality of sub-pixels arranged in a display panel and utilizing these charges. However, in the case of a conventional display device, image quality may be degraded due to a phenomenon in which each of sub-pixels may be insufficiently charged, which is problematic. In addition to such a problem, in the case of the conventional display device, an image may be blurred instead of being clearly distinguishable, or luminance differences may be caused due to different emission periods depending on line position, thereby degrading image quality.

SUMMARY

Accordingly, the present disclosure is directed to providing a display device, a gate driving circuit, and a driving method capable of improving a charging rate by performing overlap driving of sub-pixels, thereby improving image quality.

The present disclosure is also directed to providing a display device, a driving circuit, and a driving method capable of preventing afterimages and improving moving picture response time by performing fake data insertion driving to display an image (a fake image) different from real images between the real images, thereby improving moving picture quality.

The present disclosure is also directed to providing a display device, a driving circuit, and a driving method allowing overlap driving for improving a charging rate and fake data insertion driving for preventing afterimages and improving moving picture response time to be independently performed by newly disposing a dedicated structure for the fake data insertion driving on a display panel.

The present disclosure is also directed to providing a display device, a driving circuit, and a driving method capable of fundamentally preventing image display delay, which is caused by fake data insertion driving, by simultaneously performing real image driving during the fake data insertion driving, thereby making it easier to implement a high resolution.

According to an aspect of the present disclosure, there is provided a display device including: a display panel including a plurality of sub-pixels connected to a plurality of data lines and a plurality of scan signal lines, wherein each of the plurality of sub-pixels includes a light-emitting element, a driving transistor configured to drive the light-emitting element, a scan transistor configured to control a connection between the data line and a first node of the driving transistor according to a scan signal supplied through the scan signal line, and a capacitor connected between the first node and a second node of the driving transistor; a data driving circuit configured to drive the plurality of data lines; and a gate driving circuit configured to drive the plurality of scan signal lines.

The plurality of sub-pixels may be arranged in the form of a matrix to form a plurality of sub-pixel rows, and the gate driving circuit sequentially may apply a plurality of scan signals sequentially having a turn-on level voltage period to the plurality of scan signal lines.

The display device may perform overlap driving. Turn-on level voltage periods of scan signals applied to two adjacent scan signal lines among the plurality of scan signal lines may partially overlap each other.

Real display driving of an overlap driving method and fake data insertion driving (fake display driving) may be independently performed.

Fake data insertion driving (fake display driving) may be performed while real display driving of an overlap driving method is performed.

Real display driving of an overlap driving method may be performed while fake data insertion driving (fake display driving) is performed.

When a first sub-pixel disposed in a first sub-pixel row among the plurality of sub-pixel rows receives an image data voltage for displaying a real image through a first data line, second sub-pixels, which are disposed in k second sub-pixel rows (k is a natural number greater than or equal to 2) different from the first sub-pixel row among the plurality of sub-pixel rows, may be simultaneously supplied with a fake data voltage for displaying a fake image different from the real image and may include a sub-pixel connected to the first data line.

The k second sub-pixel rows may be included in one first fake driving group simultaneously displaying the fake image.

The display panel may further include a first fake data line corresponding to the first fake driving group and transmitting the fake data voltage, a first fake gate line corresponding to the first fake driving group and transmitting a fake gate signal, and a first fake switching transistor corresponding to the first fake driving group.

A gate node of the first fake switching transistor may be electrically connected to the first fake gate line, a source node or drain node of the first fake switching transistor may be electrically connected to the first fake data line, the source node or drain node of the first fake switching transistor may be electrically connected to all of the first nodes of the driving transistors of the second sub-pixels disposed in the k second sub-pixel rows included in the first fake driving group.

The plurality of sub-pixel rows may include another k sub-pixel rows adjacent to the k second sub-pixel rows, and the other k sub-pixel rows may be included in a second fake driving group simultaneously displaying the fake image at a timing different from that of the first fake driving group.

The display panel may further include a second fake data line corresponding to the second fake driving group and transmitting the fake data voltage, a second fake gate line corresponding to the second fake driving group and transmitting the fake gate signal, and a second fake switching transistor corresponding to the second fake driving group.

The display device may further include a fake data driving circuit configured to output the fake data voltage and a fake gate driving circuit configured to output the fake gate signal.

When the first fake driving group is divided into two or more sub-pixel groups, the corresponding first fake switching transistor may be disposed for each of the two or more sub-pixel groups.

The two or more sub-pixel groups obtained by dividing the first fake driving group may share one or more of the first fake gate line and the first fake data line.

The fake data voltage may be a black data voltage, a low grayscale data voltage, or a monochrome data voltage.

Each of the plurality of sub-pixels may further include a sensing transistor configured to control a connection between a reference line and the second node of the driving transistor according to a sensing signal supplied through a sensing signal line. The sensing signal applied to the sensing signal line may have the same signal waveform as the scan signal applied to the scan signal line.

The turn-on level voltage period of each of the plurality of scan signals may be greater than one horizontal time. In an example, the turn-on level voltage period of each of the plurality of scan signals may be greater than or equal to four horizontal times.

According to another aspect of the present disclosure, there is provided a driving circuit that drives a display panel including a plurality of sub-pixels connected to a plurality of data lines and a plurality of scan signal lines, wherein each of the plurality of sub-pixels includes a light-emitting element, a driving transistor configured to drive the light-emitting element, a scan transistor configured to control a connection between the data line and a first node of the driving transistor according to a scan signal supplied through the scan signal line, and a capacitor connected between the first node and a second node of the driving transistor.

The driving circuit may include a data driving circuit configured to supply an image data voltage for displaying a real image to a first sub-pixel among the plurality of sub-pixels through a first data line during a first driving period, and a fake data driving circuit configured to supply a fake data voltage for displaying a fake image different from the real image to second sub-pixels different from the first sub-pixel among the plurality of sub-pixels through a fake data line during the first driving period. The second sub-pixels may include a sub-pixel connected to the first data line.

The driving circuit may include a gate driving circuit configured to output a scan signal having a turn-on level voltage period to a first scan signal line connected to a first sub-pixel among the plurality of sub-pixels during a first driving period so that an image data voltage for displaying a real image is applied to the first node of the driving transistor of the first sub-pixel, and a fake gate driving circuit configured to output a fake gate signal having a turn-on level voltage period to a fake gate line, corresponding to second sub-pixels among the plurality of sub-pixels, during the first driving period, so that a fake data voltage for displaying a fake image different from the real image is applied to the first node of the driving transistor of each of the second sub-pixels.

The fake image may be a black image, a low grayscale image, or a monochrome image.

According to still another aspect of the present disclosure, there is provided a display device that includes a display panel including a plurality of sub-pixels connected to a plurality of data lines and a plurality of scan signal lines, wherein each of the plurality of sub-pixels includes a light-emitting element, a driving transistor configured to drive the light-emitting element, a scan transistor configured to control a connection between the data line and a first node of the driving transistor according to a scan signal supplied through the scan signal line, and a capacitor connected between the first node and a second node of the driving transistor.

According to yet another aspect of the present disclosure, there is provided a method of driving a display device including a first process of supplying an image data voltage for displaying a real image to a first sub-pixel among the plurality of sub-pixels through a first data line during a first driving period and a second process of supplying a fake data voltage for displaying a fake image different from the real image to the first sub-pixel through a first fake data line during a second driving period different from the first driving period.

In the first process, during the first driving period, the fake data voltage may be supplied to second sub-pixels different from the first sub-pixel among the plurality of sub-pixels through a second fake data line different from the first fake data line, or through the first fake data line. The second sub-pixels may include a sub-pixel connected to the first data line.

According to yet another aspect of the present disclosure, there is provided a display device including a display panel including a plurality of sub-pixels connected to a plurality of data lines and a plurality of scan signal lines, a data driving circuit configured to drive the plurality of data lines, and a gate driving circuit configured to drive the plurality of scan signal lines.

The plurality of sub-pixels may be arranged in the form of a matrix to form a plurality of sub-pixel rows and a plurality of sub-pixel columns, the plurality of scan signal lines may correspond to the plurality of sub-pixel rows, respectively, and the plurality of data lines may correspond to the plurality of sub-pixel columns, respectively. The plurality of sub-pixel rows may be grouped by k, where k is a natural number greater than or equal to 2.

The display panel may further include one or more additional data lines disposed for each group, one additional gate line disposed for one or two or more groups, and one or more additional switching transistors disposed for each group.

A specific data voltage that is not varied from frame to frame may be applied to the one or more additional data lines.

A gate node of the one or more additional switching transistors may be connected to the one additional gate line, a source node or drain node of each of the one or more additional switching transistors may be connected to the one or more additional data lines, and the source node or drain node of the one or more additional switching transistors may be connected to all of the first nodes of the driving transistors of the sub-pixels included in each group. The specific data voltage may be a black data voltage, a low grayscale data voltage, or a monochrome data voltage.

The gate driving circuit may sequentially apply a plurality of scan signals sequentially having a turn-on level voltage period to the plurality of scan signal lines. Turn-on level voltage periods of scan signals applied to two adjacent scan signal lines among the plurality of scan signal lines may partially overlap each other.

According to aspects of the present disclosure, a charging rate can be improved by performing overlap driving of sub-pixels, thereby improving image quality.

According to aspects of the present disclosure, afterimages can be prevented and moving picture response time can be improved by performing fake data insertion driving to display an image (a fake image) different from real images between the real images, thereby improving moving picture quality.

According to aspects of the present disclosure, overlap driving for improving a charging rate and the fake data insertion driving for preventing afterimages and improving moving picture response time can be performed independently by newly disposing a dedicated structure for the fake data insertion driving on the display panel.

According to aspects of the present disclosure, image display delay caused by the fake data insertion driving can be fundamentally prevented by simultaneously performing real image driving during the fake data insertion driving, thereby making it easier to implement high resolution.

BRIEF DESCRIPTION OF THE DRAWINGS

The above, features, and advantages of the present disclosure will become more apparent to those of ordinary skill in the art by describing exemplary aspects thereof in detail with reference to the accompanying drawings, in which.

DETAILED DESCRIPTION

Figure 1:
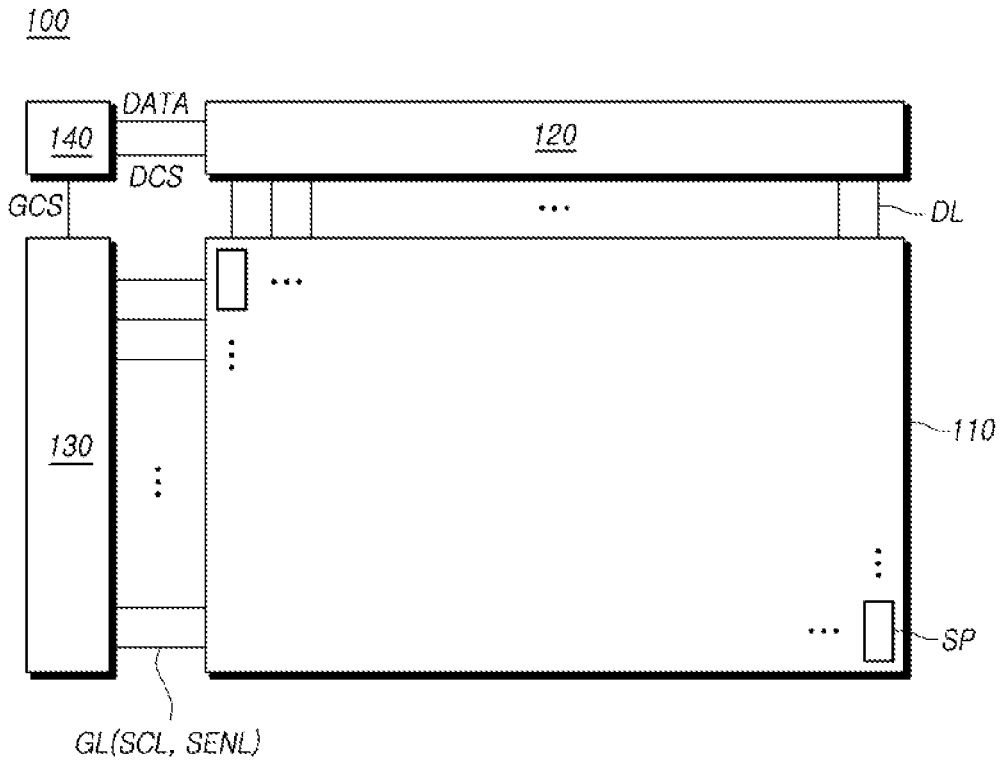
FIG. 1 is a system configuration diagram of a display device according to aspects of the present disclosure.

The present disclosure provides a structure and a driving circuit allowing overlap driving for improving a charging rate and fake data insertion driving, in which a fake image is inserted between real images to prevent afterimages and improve moving picture response time, to be simultaneously performed, thereby making it easier to implement a high resolution.

In the following description of examples or aspects of the present disclosure, reference will be made to the accompanying drawings in which it is shown by way of illustration specific examples or aspects that can be implemented, and in which the same reference numerals and signs can be used to designate the same or like components even when they are shown in different accompanying drawings from one another. Further, in the following description of examples or aspects of the present disclosure, detailed descriptions of well-known functions and components incorporated herein will be omitted when it is determined that the description may make the subject matter in some aspects of the present disclosure rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the present disclosure. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element may be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can".

Hereinafter, aspects of the present disclosure will be described in detail with reference to the drawings.

FIG. 1 is a system configuration diagram of a display device 100 according to aspects of the present disclosure.

Referring to FIG. 1, the display device 100 according to the aspects of the present disclosure may include a display panel 110 and a driving circuit for driving the display panel 110.

In a functional aspect, the driving circuit may include a data driving circuit 120, a gate driving circuit 130, and the like and may further include a controller 140 that controls the data driving circuit 120 and the gate driving circuit 130.

The display panel 110 may include a plurality of data lines DL, a plurality of scan signal lines SCL, a plurality of sensing signal lines SENL, a plurality of reference lines RL, a plurality of sub-pixels SP, and the like.

The display panel 110 may include an active area in which an image is displayed, and a non-active area in which an image is not displayed. In the active area, the plurality of sub-pixels SP for displaying an image may be disposed. In the non-active area, the driving circuits 120, 130, and 140 may be electrically connected to each other or mounted, and a pad part may be disposed.

The data driving circuit 120 is a circuit for driving the plurality of data lines DL and may supply data voltages to the plurality of data lines DL.

The gate driving circuit 130 drives a plurality of gate lines GL. For example, the plurality of gate lines GL may include the plurality of scan signal lines SCL, the plurality of sensing signal lines SENL, and the like. Accordingly, the gate driving circuit 130 may drive the plurality of scan signal lines SCL and may also drive the plurality of sensing signal lines SENL.

The controller 140 may supply various driving control signals DCS and GCS to the data driving circuit 120 and the gate driving circuit 130 in order to control the data driving circuit 120 and the gate driving circuit 130.

The controller 140 starts scanning according to the timing defined in each frame, outputs converted image data DATA by converting image data input from the outside into a data signal format used by the data driving circuit 120, and controls data driving at appropriate times in accordance with the scanning.

The controller 140 receives various types of timing signals, including a vertical synchronization signal VSYNC, a horizontal synchronization signal HSYNC, an input data enable signal DE, a clock signal CLK, and the like, together with the input image data from the outside (e.g., a host system).

The controller 140 not only outputs the converted image data by converting the image data input from the outside into the data signal format used by the data driving circuit 120, but also receives the timing signals, such as the vertical synchronization signal VSYNC, the horizontal synchronization signal HSYNC, the input data enable signal DE, the clock signal CLK, and the like, and generates various types of control signals DCS and GCS and outputs the generated control signals DCS and GCS to the data driving circuit 120 and the gate driving circuit 130 in order to control the data driving circuit 120 and the gate driving circuit 130.

For example, in order to control the gate driving circuit 130, the controller 140 outputs various types of gate control signals GCS including a gate start pulse GSP, a gate shift clock GSC, a gate output enable signal GOE, and the like.

Here, the gate start pulse GSP is used to control an operation start timing of one or more gate driver integrated circuits (ICs) constituting the gate driving circuit 130. The gate shift clock GSC is a clock signal commonly input to the one or more gate driver ICs to control a shift timing of scan signals (gate pulse). The gate output enable signal GOE designates timing information of the one or more gate driver ICs.

Further, in order to control the data driving circuit 120, the controller 140 outputs various types of data control signals DCS including a source start pulse SSP, a source sampling clock SSC, a source output enable signal SOE, and the like.

Here, the source start pulse SSP is used to control a data sampling start timing of one or more source driver ICs constituting the data driving circuit 120. The source sampling clock SSC is a clock signal used to control the sampling timing of data in each of the source driver ICs. The source output enable signal SOE is used to control an output timing of the data driving circuit 120.

The controller 140 may be implemented as a component separate from the data driving circuit 120 or may integrated with the data driving circuit 120 to be implemented as an IC.

The data driving circuit 120 receives the image data DATA from the controller 140 and supplies a data voltage to the plurality of data lines DL to drive the plurality of data lines DL. Here, the data driving circuit 120 is also referred to as a source driving circuit.

The data driving circuit 120 may be implemented by including at least one source driver IC SDIC.

Each source driver IC SDIC may include a shift register, a latch circuit, a digital-to-analog converter (DAC), an output buffer, and the like.

In some cases, each source driver IC SDIC may further include an analog-to-digital converter (ADC).

Each source driver IC SDIC may be connected to a bonding pad of the display panel 110 by a tape-automated bonding (TAB) method or a chip-on-glass (COG) method, may be directly disposed in the display panel 110, or in some cases, may be integrated with the display panel 110 and disposed. Further, each source driver IC SDIC may be implemented using a chip on film (COF) method, and in this case, each source driver IC SDIC may be mounted on a circuit film SF connected to the display panel 110 and may be electrically connected to the display panel 110 through lines on the circuit film SF.

The gate driving circuit 130 sequentially drives the plurality of scan signal lines SCL by sequentially supplying scan signals to the plurality of scan signal lines SCL. The gate driving circuit 130 may output the scan signal having a turn-on level voltage or the scan signal having a turn-off level voltage under the control of the controller 140.

The gate driving circuit 130 sequentially drives the plurality of sensing signal lines SENL by sequentially supplying sensing signals to the plurality of sensing signal lines SENL. The gate driving circuit 130 may output the sensing signal having a turn-on level voltage or the sensing signal having a turn-off level voltage under the control of the controller 140.

The plurality of scan signal lines SCL and the plurality of sensing signal lines SENL correspond to the gate lines GL. The scan signal and the sensing signal correspond to a gate signal applied to a gate node of a transistor.

The gate driving circuit 130 may be connected to the bonding pad of the display panel 110 by a TAB method or a COG method, or may be implemented as a gate-in-panel (GIP) type and directly disposed in the display panel 110, or in some cases, may be integrated with the display panel 110 and disposed. Alternatively, the gate driving circuit 130 may be implemented in the form of an IC and mounted on a film connected to the display panel 110.

When a specific scan signal line SCL is opened by the gate driving circuit 130, the data driving circuit 120 converts the image data DATA, received from the controller 140, into an analog-type data voltage and supplies the converted analog-type data voltage to the plurality of data lines DL.

The data driving circuit 120 may be located only on one side of the display panel 110 (e.g., above or below the display panel 110), and in some cases, the data driving circuit 120 may be located on both sides of the display panel 110 (e.g., above and below the display panel 110) depending on a driving method, a panel design method, or the like.

The gate driving circuit 130 may be located only on one side of the display panel 110 (e.g., a left or right side of the display panel 110), and in some cases, the gate driving circuit 130 may be located on both sides of the display panel 110 (e.g., left and right sides of the display panel 110) depending on a driving method, a panel design method, or the like.

The controller 140 may be a timing controller used in a conventional display technique or a control device that further performs other control functions in addition to the function of a timing controller, may be a control device different from a timing controller, or may be a circuit in the control device. The controller 140 may be implemented as various circuits or electronic components, such as ICs, field-programmable gate arrays (FPGAs), application-specific integrated circuits (ASICs), processors, or the like.

The controller 140 may be mounted on a printed circuit board, a flexible printed circuit board, or the like, and may be electrically connected to the data driving circuit 120 and the gate driving circuit 130 through the printed circuit board, the flexible printed circuit board, or the like.

The controller 140 may transmit and receive signals to and from the data driving circuit 120 according to one or more predetermined interfaces. Here, for example, the interfaces may include a low voltage differential signaling (LVDS) interface, an embedded panel interface (EPI), a serial peripheral interface (SPI), and the like.

The controller 140 may transmit and receive signals to and from the data driving circuit 120 and the gate driving circuit 130 according to one or more predetermined interfaces. Here, for example, the interfaces may include an LVDS interface, an EPI, an SPI, and the like. The controller 140 may include storage units such as one or more registers or the like.

The display device 100 according to the present aspects may be a self-emitting display such as an organic light-emitting diode (OLED) display, a quantum dot display, a micro light-emitting diode (LED) display, or the like.

In the case that the display device 100 according to the present aspects is an OLED display, each of the sub-pixels SP may include an OLED, emitting light by itself, as a light-emitting element. In the case that the display device 100 according to the present aspects is a quantum dot display, each sub-pixel SP may include a light-emitting element made of quantum dots that is a semiconductor crystal emitting light by itself. In the case that the display device 100 according to the present aspects is a micro LED display, each sub-pixel SP may include a micro LED, which emits light by itself and is made of an inorganic material, as a light-emitting element.

Figure 2:
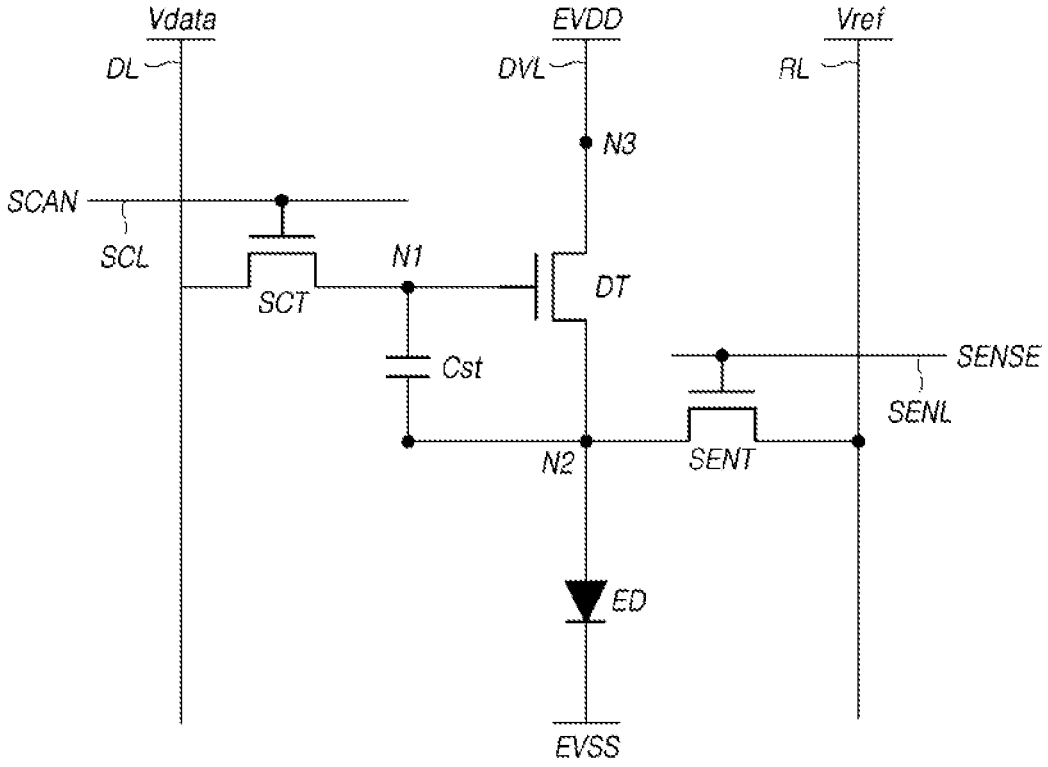
FIG. 2 is a diagram illustrating an equivalent circuit of a sub-pixel disposed in a display panel of the display device according to aspects of the present disclosure.

FIG. 2 is a diagram illustrating an equivalent circuit of the sub-pixel SP disposed in the display panel 110 of the display device 100 according to the aspects of the present disclosure.

As an example, each of the plurality of sub-pixels SP may include a light-emitting element ED, a driving transistor DT, a scan transistor SCT, and a storage capacitor Cst. Such a sub-pixel structure is referred to as a two transistors and one capacitor (2T1C) structure.

Referring to FIG. 2, each of the plurality of sub-pixels SP may further include a sensing transistor SENT in addition to the light-emitting element ED, the driving transistor DT, the scan transistor SCT, and the storage capacitor Cst. Such a sub-pixel structure is referred to as a three transistors and one capacitor (3T1C) structure.

The light-emitting element ED may include an anode, a cathode, and a light-emitting layer positioned between the anode and the cathode. For example, the light-emitting element ED may be an OLED, an LED, a quantum dot light-emitting element, or the like.

The driving transistor DT is a transistor for driving the light-emitting element ED and may include a first node N1, a second node N2, a third node N3, and the like.

The first node N1 of the driving transistor DT may be a gate node and may be electrically connected to a source node or drain node of the scan transistor SCT.

The second node N2 of the driving transistor DT may be a source node or drain node, may be electrically connected to a source node or drain node of the sensing transistor SENT, and may also be electrically connected to the anode of the light-emitting element ED.

The third node N3 of the driving transistor DT may be electrically connected to a driving voltage line DVL through which a driving voltage EVDD is supplied.

The scan transistor SCT may be turned on or off in response to the scan signal SCAN, supplied through the scan signal line SCL, to control the connection of the data line DL and the first node N1 of the driving transistor DT.

The scan transistor SCT may be turned on in response to the scan signal SCAN having a turn-on level voltage to transfer a data voltage Vdata, supplied through the data line DL, to the first node N1 of the driving transistor DT.

The sensing transistor SENT may be turned on or off in response to a sensing signal SENSE, supplied through the sensing signal line SENL, to control the connection of the reference line RL and the second node N2 of the driving transistor DT.

The sensing transistor SENT may be turned on in response to the sensing signal SENSE having a turn-on level voltage to transfer a reference voltage Vref, supplied through the reference line RL, to the second node N2 of the driving transistor DT.

Further, the sensing transistor SENT may be turned on in response to the sensing signal SENSE having a turn-on level voltage to transfer a voltage of the second node N2 of the driving transistor DT to the reference line RL.

The function of the sensing transistor SENT that transfers the voltage of the second node N2 of the driving transistor DT to the reference line RL may be used in driving to sense a characteristic value (e.g., a threshold voltage or mobility) of the driving transistor DT. In this case, the voltage transferred to the reference line RL may be a voltage used to calculate the characteristic value of the driving transistor DT.

The function of the sensing transistor SENT that transfers the voltage of the second node N2 of the driving transistor DT to the reference line RL may also be used in driving to sense a characteristic value (e.g., a threshold voltage) of the light-emitting element ED. In this case, the voltage transferred to the reference line RL may be a voltage used to calculate the characteristic value of the light-emitting element ED.

Each of the driving transistor DT, the scan transistor SCT, and the sensing transistor SENT may be an n-type transistor or a p-type transistor. For convenience of description, the case in which each of the driving transistor DT, the scan transistor SCT, and the sensing transistor SENT is an n-type will be described hereinafter by way of example.

The capacitor Cst may be connected between the first node N1 and the second node N2 of the driving transistor DT. The capacitor Cst is charged with an amount of charges corresponding to a voltage difference between both ends thereof and serves to maintain the voltage difference between both ends thereof during a predetermined frame time. Accordingly, light may be emitted from the corresponding sub-pixel SP during the predetermined frame time.

The capacitor Cst may be an external capacitor intentionally designed to be disposed outside the driving transistor DT, rather than a parasitic capacitor (e.g., Cgs or Cgd), which is an internal capacitor present between the gate node and the source node (or the drain node) of the driving transistor DT.

Figure 3:
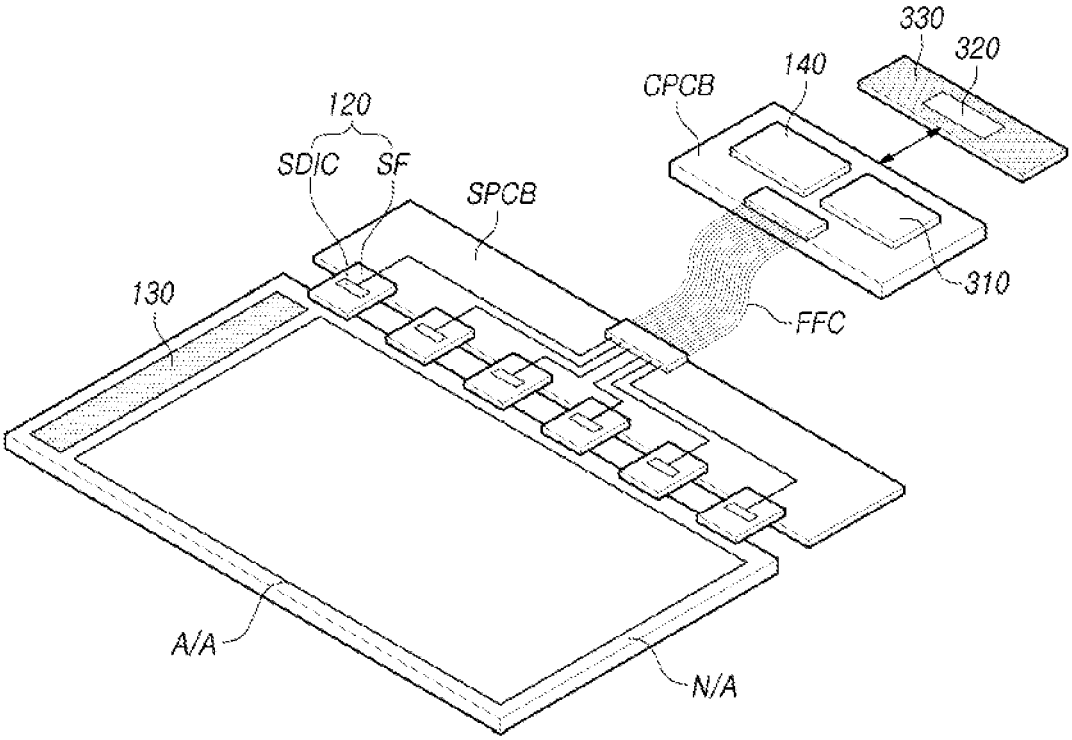
FIG. 3 is a diagram illustrating system implementation of the display device according to aspects of the present disclosure.

FIG. 3 is a diagram illustrating system implementation example of the display device 100 according to the aspects of the present disclosure.

Referring to FIG. 3, the display panel 110 may include an active area A/A in which an image is displayed, and a non-active area N/A in which an image is not displayed.

Referring to FIG. 3, when the data driving circuit 120 is implemented by a COF method, each source driver IC SDIC included in the data driving circuit 120 may be mounted on a film SF connected to the non-active area N/A of the display panel 110.

Referring to FIG. 3, the gate driving circuit 130 may be implemented in a GIP type. In this case, the gate driving circuit 130 may be formed in the non-active area N/A of the display panel 110. The gate driving circuit 130 may also be implemented in a COF type unlike in FIG. 3.

In order to provide circuit connections of one or more source driver ICs SDIC to other devices, the display device 100 may include at least one source printed circuit board SPCB and a control printed circuit board CPCB for mounting control components and various types of electric devices thereon.

The film SF on which the source driver IC SDIC is mounted may be connected to the at least one source printed circuit board SPCB. That is, one side of the film SF, on which the source driver IC SDIC is mounted, may be electrically connected to the display panel 110, and the other side of the film SF may be electrically connected to the source printed circuit board SPCB.

The controller 140 configured to control the operation of the data driving circuit 120, the gate driving circuit 130, and the like, a power management IC (PMIC) 310 configured to supply various voltages or currents to the display panel 110, the data driving circuit 120, the gate driving circuit 130, and the like, or the like may be mounted on the control printed circuit board CPCB. The power management IC 310 may control various voltages or currents to be supplied to the display panel 110, the data driving circuit 120, the gate driving circuit 130, and the like.

A circuit connection of the at least one source printed circuit board SPCB and the control printed circuit board CPCB may be enabled by at least one connecting member. Here, the connecting member may be, for example, a flexible printed circuit (FPC), a flexible flat cable (FFC), or the like. The at least one source printed circuit board SPCB and the control printed circuit board CPCB may be implemented by being integrated into a single printed circuit board.

The display device 100 may further include a set board 330 electrically connected to the control printed circuit board CPCB. The set board 330 may also be referred to as a power board. A main power management circuit (M-PMC) 320 performing overall power management of the display device 100 may be present on the set board 330.

The power management IC 310 is a circuit managing the power of a display module including the display panel 110, the driving circuits 120, 130, and 140 of the display panel 110, and the like. The main power management circuit 320 is a circuit managing the power of the entire system, including the display module, and may interwork with the power management IC 310.

Figure 4:
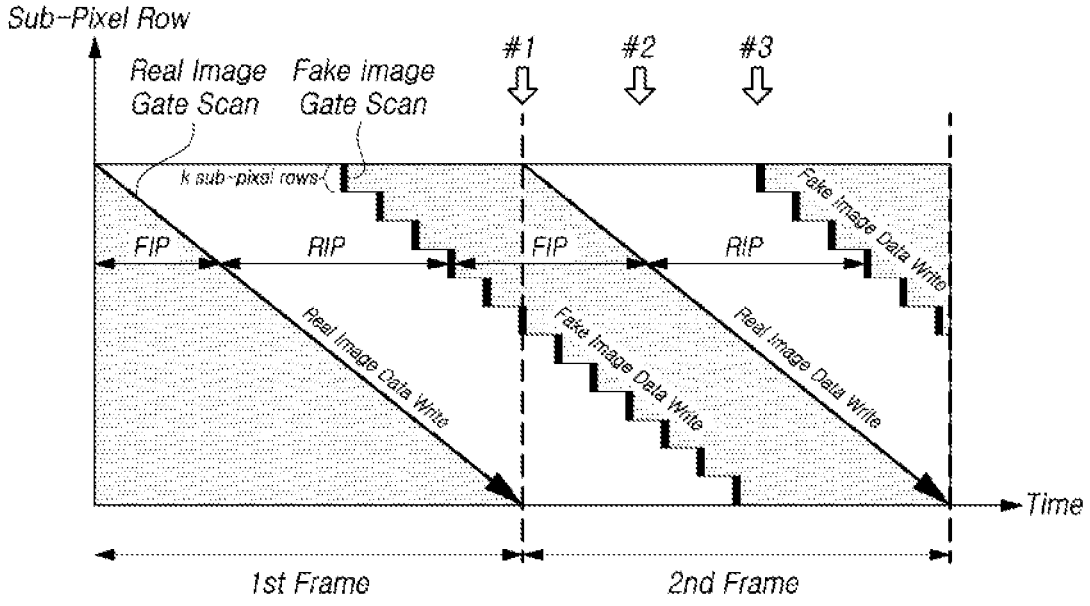
FIG. 4 is a diagram illustrating fake data insertion driving in the display device according to aspects of the present disclosure.
Figure 5:
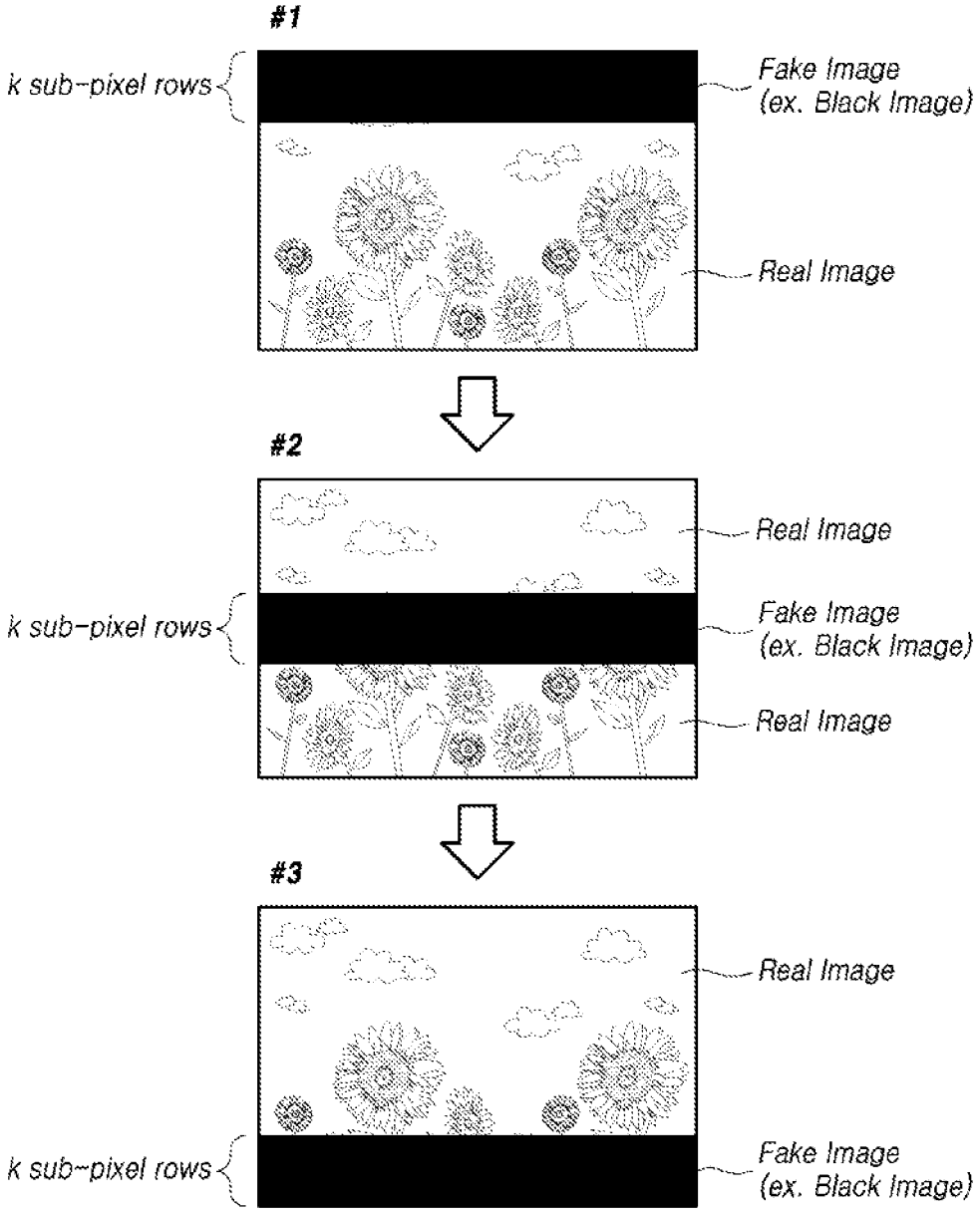
FIG. 5 is a diagram illustrating a screen of the display device according to aspects of the present disclosure, in which changes occur in response to the fake data insertion driving.

FIG. 4 is a diagram illustrating fake data insertion (FDI) driving in the display device 100 according to the aspects of the present disclosure, and FIG. 5 is a diagram illustrating a screen of the display device 100 according to the aspects of the present disclosure, in which changes occur in response to the fake data insertion driving.

Referring to FIG. 4, the display device 100 according to the aspects of the present disclosure may perform a function of inserting and displaying a fake image different from a real image in the middle within one frame time in order to prevent afterimages, thereby improving moving picture quality and moving picture response time (MPRT). Before describing the fake data insertion driving function, the structure and operation of the display panel 110 will be briefly described.

The plurality of sub-pixels SP disposed in the display panel 110 may be arranged in the form of a matrix. Accordingly, the plurality of sub-pixels SP disposed in the display panel 110 form a plurality of sub-pixel rows. The plurality of sub-pixel rows may be sequentially scanned.

When each sub-pixel SP has a 3T1C structure, a scan signal line SCL for transmitting a scan signal SCAN and a sensing signal line SENL for transmitting a sensing signal SENSE may be disposed in each of the plurality of sub-pixel rows.

A plurality of sub-pixel columns may be present in the display panel 110, and one data line DL may be disposed in each of the plurality of sub-pixel columns, in a corresponding manner. In some cases, one data line DL may be disposed for every two or three or more sub-pixel columns.

The plurality of sub-pixel rows disposed in the display panel 110 are sequentially driven. As in the above-described sub-pixel driving operation, when an (n+1)th sub-pixel row among the plurality of sub-pixel rows is driven, the scan signal SCAN and the sensing signal SENSE are applied to the sub-pixels SP arranged in the (n+1)th sub-pixel row, and an image data voltage Vdata is applied to the sub-pixels SP, which are arranged in the (n+1)th sub-pixel row R(n+1) through the plurality of data lines DL.

Next, an (n+2)th sub-pixel row, located below the (n+1)th sub-pixel row, is driven. The scan signal SCAN and the sensing signal SENSE are applied to the sub-pixels SP arranged in the (n+2)th sub-pixel row, and the image data voltage Vdata is applied to the sub-pixels SP, which is arranged in the (n+2)th sub-pixel row R(n+2) through the plurality of data lines DL.

In this manner, image data writing is sequentially performed in the plurality of sub-pixel rows. Here, the image data writing is the procedure performed in the image data writing process of the sub-pixel driving operation as described above.

An image data writing process, a boosting process, and a light emission process may be performed sequentially on the plurality of sub-pixel rows during one frame time in response to the above-described sub-pixel driving operation.

Referring to FIG. 4, in each of the plurality of sub-pixel rows, a "real image period RIP", in which a real image is displayed according to the light emission process of the sub-pixel driving operation, does not continue through the entirety of one frame time. Here, the real image period RIP may also be referred to as a "light emission period."

In the present specification, the "real image" refers to an image that is actually visible to a user. In the present specification, an operation for displaying the real image is referred to herein as "real display driving."

In the present specification, a "fake image" is referred to herein as an image different from the "real image." In the present specification, the "fake image" is an image that is not actually visible to the user but is displayed between real images or displayed together with a real image in a frame screen. Thus, the "fake image" is an image that a user does not recognize since the fake image appears for a very short time and then disappears. For example, the fake image according to the aspects of the present disclosure may be a black image, a low grayscale image, a monochrome image, or the like, and may be any image that the user cannot recognize. In the present specification, an operation for displaying a fake image is referred to as "fake display driving."

Referring to FIG. 4, in each of the plurality of sub-pixel rows, the real display driving may be performed during a partial period (RIP) of one frame time and the fake display driving may be performed during the remaining period (FIP) of one frame time.

Referring to FIG. 4, during one frame time, a single sub-pixel SP emits light during the real image period RIP, which corresponds to the partial period of one frame time and is a period displaying a real image, by performing the real display driving (the image data writing process, the boosting process, and the light emission process), and then, displays the fake image different from the real image or does not emit light during the remaining period of one frame time other than the real image period RIP by performing the fake display driving.

The period during which the sub-pixel SP does not emit light or displays a fake image in one frame time is referred to as a "fake image period FIP." Here, the "fake image period FIP" may also be referred to as a non-emission period.

The fake display driving is fake driving different from the real display driving for displaying a real image, and is driving for displaying a fake image between real images. The fake display driving may be performed through a method of inserting a fake image between real images.

Accordingly, the fake display driving is also referred to as "fake data insertion (FDI) driving." In the following, the fake display driving is referred to as "fake data insertion (FDI) driving."

In the real display driving, image data voltages Vdata corresponding to real images are supplied to the sub-pixels SP in order to display the real images. In contrast, in the fake data insertion driving, a fake data voltage corresponding to a fake image, unrelated to real images, is supplied to one or more sub-pixels SP.

That is, although the image data voltages Vdata, which are supplied to the sub-pixels SP during the typical real display driving, may be varied depending on the frame or the image, the fake data voltage, which is supplied to one or more sub-pixels SP during the fake data insertion driving, may be constant without being varied depending on the frame or the image.

Hereinafter, a data voltage corresponding to a real image is referred to as an image data voltage or a real image data voltage, and a data voltage corresponding to a fake image is referred to as a fake data voltage or a fake image data voltage. For example, the fake data voltage may be a black data voltage, a low grayscale data voltage, a monochrome data voltage, or the like.

Referring to FIG. 4, during the real display driving, the plurality of sub-pixel rows are scanned one by one to sequentially write real image data (real image data writing). Accordingly, the plurality of scan signal lines SCL corresponding to the plurality of sub-pixel rows are sequentially scanned one by one (real image gate scanning).

Referring to FIG. 4, during the fake display driving (the fake data insertion driving), k (k is a natural number of 2 or more) rows among the plurality of sub-pixel rows are sequentially scanned to write fake data (fake image data writing). That is, the fake data is simultaneously written in k sub-pixel rows at one time point. Accordingly, the plurality of scan signal lines SCL corresponding to k rows among the plurality of sub-pixel rows are sequentially scanned (fake image gate scanning).

In other words, during the fake data insertion driving, the fake data voltage may be simultaneously supplied to the k sub-pixel rows at one time point. "k", which is the number of sub-pixel rows simultaneously subjected to the fake data insertion driving at one time point, is a natural number of 2 or more. For example, the number k of sub-pixel rows simultaneously subjected to the fake data insertion driving at one time point may be two, four, eight, or the like.

Referring to FIGS. 4 and 5, assuming that the fake image is a black image, at a first time point #1, a fake image may be displayed in an area in which k sub-pixel rows, located in an upper end portion of a screen, are located, and a real image may be displayed in the remaining area of the screen. At a second time point #2, a fake image may be displayed in an area in which k sub-pixel rows, located in a middle portion of the screen, are located, and real images may be displayed in the remaining upper and lower areas of the screen. At a third time point #3, a fake image may be displayed in an area in which k sub-pixel rows, located in a lower end portion of the screen, are located, and a real image may be displayed in the remaining area of the screen.

Figure 6:
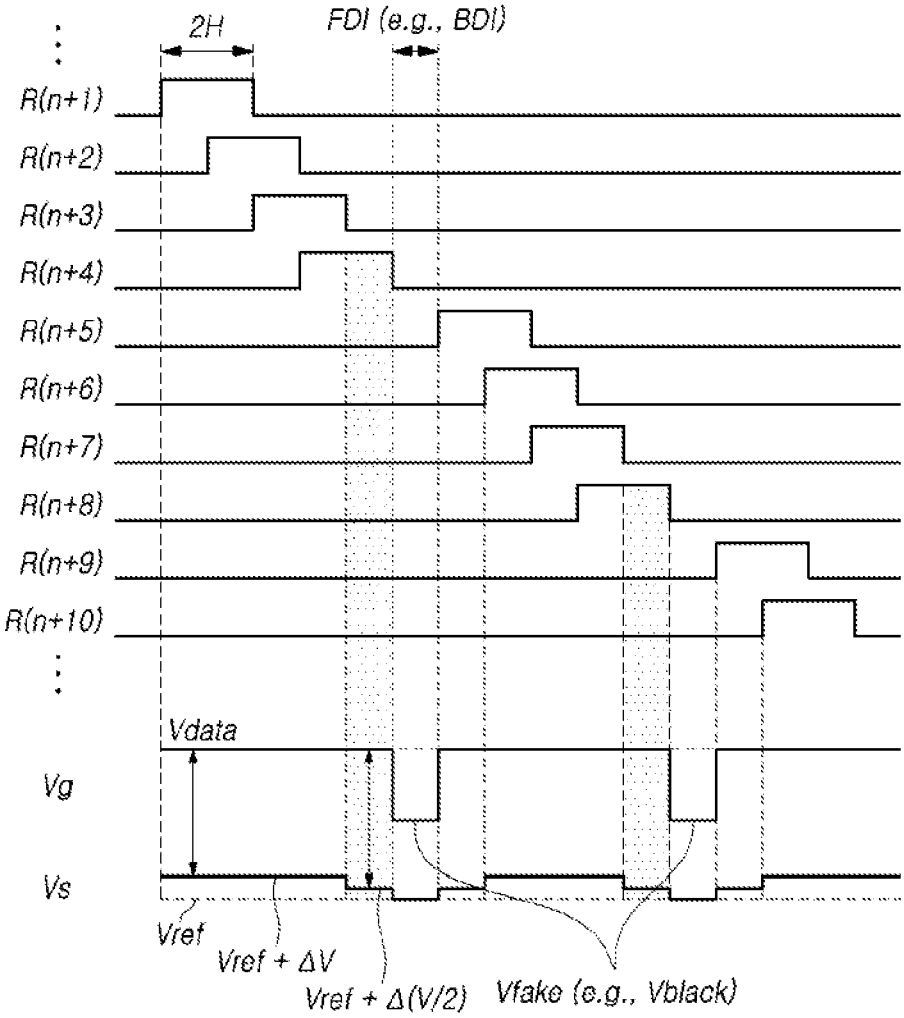
FIGS. 6 and 7 are diagrams illustrating the driving timing when the display device according to aspects of the present disclosure performs the fake data insertion driving and overlap driving.
Figure 7:
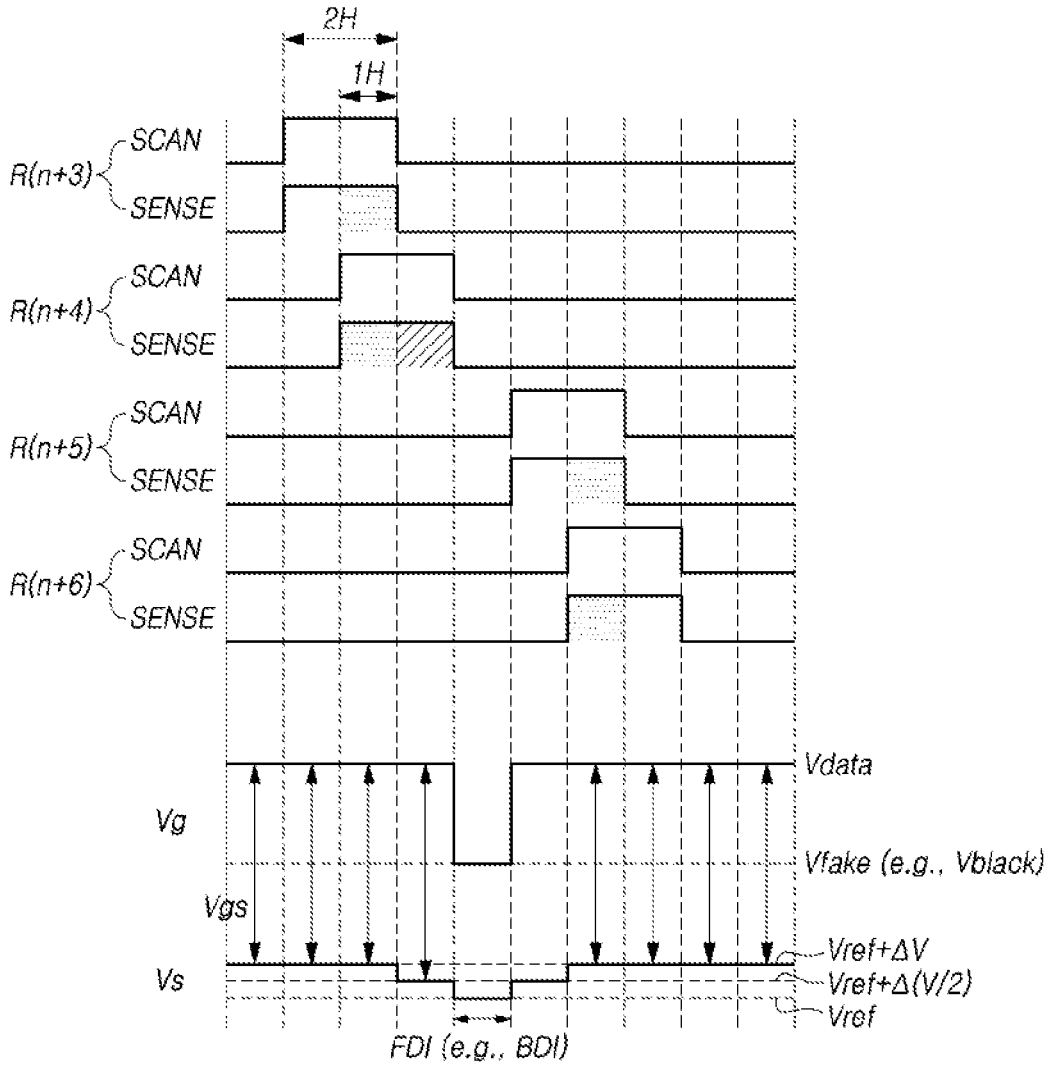

FIGS. 6 and 7 are diagrams illustrating driving timing when the display device 100 according to the aspects of the present disclosure performs the fake data insertion driving and overlap driving.

FIG. 6 is a timing diagram illustrating a scan signal SCAN sequentially applied to a plurality of scan signal lines SCL respectively corresponding to a plurality of sub-pixel rows ( . . . , R(n+1), R(n+2), . . . , R(n+10), and . . . ), and FIG. 7 is a timing diagram illustrating a scan signal SCAN and a sensing signal SENSE that are sequentially applied to a plurality of scan signal lines SCL respectively corresponding to third to sixth sub-pixel rows (R(n+3), R(n+4), R(n+5), and R(n+6)) among the plurality of sub-pixel rows ( . . . , R(n+1), R(n+2), . . . , R(n+10), and . . . ).

Referring to FIG. 6, the display device 100 according to the aspects of the present disclosure may perform overlap driving so that the charging time in the sub-pixels SP disposed in each of the plurality of sub-pixel rows ( . . . , R(n+1), R(n+2), . . . , R(n+10), and . . . ) is sufficiently secured, thereby accurately expressing images.

The scan signals SCAN of the plurality of sub-pixel rows ( . . . , R(n+1), R(n+2), . . . , R(n+10), and . . . ) sequentially have a turn-on level voltage period (represented by a period with a high level voltage in FIG. 6).

According to the overlap driving, the scan signal SCAN of each of the plurality of sub-pixel rows ( . . . , R(n+1), R(n+2), . . . , R(n+10), and . . . ) has a turn-on level voltage period with a horizontal time greater (e.g., 2H) than one horizontal time (1H). In addition, the turn-on level voltage periods of the scan signals SCAN of the plurality of sub-pixel rows ( . . . , R(n+1), R(n+2), . . . , R(n+10), and . . . ) may partially overlap each other.

For example, the rear portion of the turn-on level voltage period of the scan signal SCAN, which has two horizontal times (2H), applied to a first sub-pixel row R(n+1) may overlap the front portion of the turn-on level voltage period of the scan signal SCAN, which has two horizontal times (2H), applied to a second sub-pixel row R(n+2).

Hereinafter, a driving method in which the above-described fake display driving (the fake data insertion driving) and the overlap driving are combined will be described.

Referring to FIG. 6, real image data writing is sequentially performed on the first sub-pixel row R(n+1), the second sub-pixel row R(n+2), a third sub-pixel row R(n+3), and a fourth sub-pixel row R(n+4).

Then, k sub-pixel rows different from the first to fourth sub-pixel rows R(n+1) to R(n+4) in the display panel 110 may be subjected to the fake data insertion driving, and thus fake image data writing may be performed on the k sub-pixel rows. Here, the k sub-pixel rows on which the fake image data writing is performed are sub-pixel rows disposed ahead of the first sub-pixel row R(n+1) and may be sub-pixel rows on which the real image period RIP of a predetermined time has already been performed.

Afterwards, the real image data writing is sequentially performed on a fifth sub-pixel row R(n+5), a sixth sub-pixel row R(n+6), a seventh sub-pixel row R(n+7), and an eighth sub-pixel row R(n+8).

Then, k sub-pixel rows different from the fifth to eighth sub-pixel rows R(n+5) to R(n+8) in the display panel 110 may be subjected to the fake data insertion driving, and thus the fake image data writing may be performed on the k sub-pixel rows. Here, the k sub-pixel rows, on which the fake image data writing is performed, are sub-pixel rows disposed ahead of the fifth sub-pixel row R(n+5) and may be sub-pixel rows on which the real image period RIP of a predetermined time has already been performed.

The number k of sub-pixel rows, simultaneously subjected to the fake data insertion driving, may be the same or different. In an example, first two sub-pixel rows may be simultaneously subjected to the fake data insertion driving, and then in the unit of four sub-pixel rows, the fake data insertion driving may be simultaneously performed. In another example, first four sub-pixel rows may be simultaneously subjected to the fake data insertion driving, and then in the unit of eight sub-pixel rows, the fake data insertion driving may be simultaneously performed.

Since both the real image data and the fake image data are displayed in the same frame by performing the above-described fake data insertion driving, motion blurring, in which an image is blurred instead of being clearly distinguishable, may be prevented, thereby improving image quality.

In the above-described fake data insertion driving, the real image data writing and the fake image data writing may be performed through the data lines DL.

In addition, since the fake image data writing may be performed simultaneously on the plurality of sub-pixel rows as described above, luminance differences, due to the difference in the real image period RIP depending on the position of the sub-pixel row, may be compensated for, so that an image data writing time may be secured.

Meanwhile, the lengths of the real image period RIP may be adaptively adjusted depending on the image by adjusting the timing of the fake data insertion driving The image data writing timing and the fake image data writing timing may be varied by controlling the gate driving.

For example, when a fake data voltage Vfake is a black data voltage Vblack, that is, when the fake image is a black image, the fake data insertion driving may also be referred to as black data insertion (BDI) driving.

The period in which k sub-pixel rows do not emit light due to the fake data insertion driving is referred to as a fake image period FIP. Since the fake image may be a black image as an example, the fake image period FIP may also be referred to as a black image period.

Meanwhile, the gate driving of each of the plurality of sub-pixel rows ( . . . , R(n+1), R(n+2), R(n+3), R(n+4), R(n+5), and . . . ) may be performed sequentially to overlap for predetermined lengths of time.

Referring to FIG. 7, the scan signal SCAN and the sensing signal SENSE of each of the plurality of sub-pixel rows ( . . . , R(n+1), R(n+2), R(n+3), R(n+4), R(n+5), and . . . ) may be the same. That is, in the overlap driving, the scan transistor SCT and the sensing transistor SENT included in each of the plurality of sub-pixel rows ( . . . , R(n+1), R(n+2), R(n+3), R(n+4), R(n+5), and . . . ) may be simultaneously turned on or off. That is, in the overlap driving, the scan signal SCAN and the sensing signal SENSE applied to the scan transistor SCT and the sensing transistor SENT, respectively, included in each of the plurality of sub-pixel rows ( . . . , R(n+1), R(n+2), R(n+3), R(n+4), R(n+5), and . . . ) may be the same gate signal having a turn-on level voltage period at the same timing.

According to the examples of FIGS. 6 and 7, the length of the turn-on level voltage periods of the gate signals SCAN and SENSE supplied to each of the plurality of sub-pixel rows ( . . . , R(n+1), R(n+2), R(n+3), R(n+4), R(n+5), and . . . ) may be, for example, 2H.

According to the examples of FIGS. 6 and 7, the turn-on level voltage periods of the gate signals SCAN and SENSE supplied to each of the plurality of sub-pixel rows ( . . . , R(n+1), R(n+2), R(n+3), R(n+4), R(n+5), and . . . ) may overlap each other.

The length of both turn-on level voltage periods of the gate signals SCAN and SENSE supplied to each of the plurality of sub-pixel rows ( . . . , R(n+1), R(n+2), R(n+3), R(n+4), R(n+5), and . . . ) may be 2H.

The turn-on level voltage periods (2H) of the scan signal SCAN and the sensing signal SENSE, which are applied to the scan transistor SCT and the sensing transistor SENT of the sub-pixels SP arranged in the sub-pixel row R(n+1), respectively, may overlap the turn-on level voltage periods (2H) of the scan signal SCAN and the sensing signal SENSE, which are applied to the scan transistor SCT and the sensing transistor SENT of the sub-pixels SP arranged in the sub-pixel row R(n+2), respectively, by 1H.

The turn-on level voltage periods (2H) of the scan signal SCAN and the sensing signal SENSE, which are applied to the scan transistor SCT and the sensing transistor SENT of the sub-pixels SP arranged in the sub-pixel row R(n+2), respectively, may overlap the turn-on level voltage periods (2H) of the scan signal SCAN and the sensing signal SENSE, which are applied to the scan transistor SCT and the sensing transistor SENT of the sub-pixels SP arranged in the sub-pixel row R(n+3), respectively, by 1H.

The turn-on level voltage periods (2H) of the scan signal SCAN and the sensing signal SENSE, which are applied to the scan transistor SCT and the sensing transistor SENT of the sub-pixels SP arranged in the sub-pixel row R(n+3), respectively, may overlap the turn-on level voltage periods (2H) of the scan signal SCAN and the sensing signal SENSE, which are applied to the scan transistor SCT and the sensing transistor SENT of the sub-pixels SP arranged in the sub-pixel row R(n+4), respectively, by 1H.

According to the examples of FIGS. 6 and 7, the length of the turn-on level voltage periods of the two gate signals SCAN and SENSE in each of the sub-pixel rows is 2H, and the turn-on level voltage periods of the two gate signals SCAN and SENSE in two adjacent sub-pixel rows may overlap each other by 1H. When the length of the turn-on level voltage periods of the two gate signals SCAN and SENSE in each of the sub-pixel rows is 2H as illustrated in FIGS. 6 and 7, the gate driving is referred to as 2H overlap driving.

The overlap driving may be modified to have various forms, other than the 2H overlap driving.

In another example of the overlap driving, the length of the turn-on level voltage periods of the two gate signals SCAN and SENSE in each of the sub-pixel rows is 3H, and the turn-on level voltage periods of the two gate signals SCAN and SENSE in two adjacent sub-pixel rows may overlap each other by 2H.

In another example of the overlap driving, the length of the turn-on level voltage periods of the two gate signals SCAN and SENSE in each of the sub-pixel rows is 3H, and the turn-on level voltage periods of the two gate signals SCAN and SENSE in two adjacent sub-pixel rows may overlap each other by 1H.

In another example of the overlap driving, the length of the turn-on level voltage periods of the two gate signals SCAN and SENSE in each of the sub-pixel rows is 4H, and the turn-on level voltage periods of the two gate signals SCAN and SENSE in two adjacent sub-pixel rows may overlap each other by 3H.

As described above, there may be various types of overlap driving, but for convenience of description, the 2H overlap driving will mainly be described hereinafter by way of example.

In the 2H overlap driving as described above, the front portion (a length of 1H) of the turn-on level voltage period (a length of 2H) of the two gate signals SCAN and SENSE in each of the sub-pixel rows ( . . . , R(n+1), R(n+2), R(n+3), R(n+4), R(n+5), and . . . ) is a gate signal portion for pre-charge (PC) driving in which the data voltage (which serves as a pre-charge data voltage) is applied to the corresponding sub-pixel. The rear portion (a length of 1H) of the turn-on level voltage period of the two gate signals SCAN and SENSE in each sub-pixel row is a gate signal portion, at which the image data writing is performed to apply the real image data voltage Vdata to the corresponding sub-pixel.

The charging rate in each sub-pixel may be improved by performing the above-described overlap driving, thereby improving image quality.

When the above-described fake data insertion driving and overlap driving are simultaneously performed, the turn-on level voltage period of the two gate signals SCAN and SENSE in the sub-pixel row R(n+3) overlaps the turn-on level voltage period of the two gate signals SCAN and SENSE in the sub-pixel row R(n+4).

Here, the rear 1H period portion of the turn-on level voltage period of the two gate signals SCAN and SENSE in the sub-pixel row R(n+3) is a period overlapping the turn-on level voltage period of the two gate signals SCAN and SENSE in the next sub-pixel row R(n+4), and is a period in which the image data writing is performed on the sub-pixel row R(n+3).

The front 1H period portion of the turn-on level voltage period of the two gate signals SCAN and SENSE in the sub-pixel row R(n+4) is a pre-charge driving period. In addition, the sub-pixel row R(n+3) and the sub-pixel row R(n+4) are sub-pixel rows in which the image data writing is performed before the fake data insertion driving proceeds.

Further, the turn-on level voltage period of the two gate signals SCAN and SENSE in the sub-pixel row R(n+5) overlaps the turn-on level voltage period of the two gate signals SCAN and SENSE in the sub-pixel row R(n+6).

Here, the rear 1H period portion of the turn-on level voltage period of the two gate signals SCAN and SENSE in the sub-pixel row R(n+5) is a period overlapping the turn-on level voltage periods of the two gate signals SCAN and SENSE in the next sub-pixel row R(n+6), and is a period in which the image data writing is performed on the sub-pixel row R(n+5). The front 1H period portion of the turn-on level voltage period of the two gate signals SCAN and SENSE in the sub-pixel row R(n+6) is a pre-charge driving period. In addition, the sub-pixel row R(n+5) and the sub-pixel row R(n+6) are sub-pixel rows in which the image data writing is performed before the fake data insertion driving proceeds.

However, the turn-on level voltage period of the two gate signals SCAN and SENSE in the sub-pixel row R(n+4) does not overlap the turn-on level voltage period of the two gate signals SCAN and SENSE in the next sub-pixel row R(n+5) directly before the fake data insertion driving proceeds.

The rear 1H period portion of the turn-on level voltage period of the two gate signals SCAN and SENSE in the sub-pixel row R(n+4) is a period in which the image data writing is performed on the sub-pixel row R(n+4).

The next sub-pixel row R(n+5) is not subjected to the pre-charge driving during the rear 1H period portion of the turn-on level voltage period of the two gate signals SCAN and SENSE in the sub-pixel row R(n+4).

On the basis of the fake data insertion driving period, the sub-pixel row R(n+4) is a sub-pixel row in which the image data writing is performed, directly before the fake data insertion driving, and the sub-pixel row R(n+5) is a sub-pixel row in which the image data writing is performed, directly after the fake data insertion driving.

The turn-on level voltage period of the two gate signals SCAN and SENSE in the sub-pixel row R(n+4) and the turn-on level voltage period of the two gate signals SCAN and SENSE in the next sub-pixel row R(n+5) are separated from each other due to a period in which the fake data insertion driving proceeds.

In FIGS. 6 and 7, the Vg graph illustrates all voltages of the first nodes N1 of the driving transistors DT in the sub-pixels included in the sub-pixel rows, indicating changes in a voltage state before entering the boosting process in the sub-pixel driving operation procedure.

In FIGS. 6 and 7, the Vs graph illustrates all voltages of the second nodes N2 of the driving transistors DT in the sub-pixels included in the sub-pixel rows, indicating changes in a voltage state before entering the boosting process in the sub-pixel driving operation procedure.

Referring to the Vg graph in FIGS. 6 and 7, in the remaining period except for the period in which the fake data insertion is in progress, a voltage Vg of the first node N1 of the driving transistor DT in each of the sub-pixels included in each sub-pixel row is an image data voltage Vdata in response to the progress of the image data writing.

However, during the period in which the fake data insertion proceeds, the voltage Vg of the first node N1 of the driving transistor DT in each of the sub-pixels included in the sub-pixel rows, which is subjected to the fake data insertion driving, has the fake data voltage Vfake.

Meanwhile, as described above, the rear period portion of the turn-on level voltage period of the two gate signals SCAN and SENSE in each of the sub-pixel rows R(n+1), R(n+2), and R(n+3) overlaps the front period portion of the turn-on level voltage period of the two gate signals SCAN and SENSE in the next sub-pixel row. However, the rear period portion of the turn-on level voltage period of the two gate signals SCAN and SENSE in the sub-pixel row R(n+4) does not overlap the front period portion of the turn-on level voltage period of the two gate signals SCAN and SENSE in the sub-pixel row R(n+5).

Accordingly, during the turn-on level voltage period of the two gate signals SCAN and SENSE in each of the sub-pixel rows R(n+1), R(n+2), and R(n+3), a voltage Vs of the second node N2 of the driving transistor DT of each of the sub-pixels included in the sub-pixel rows R(n+1), R(n+2), and R(n+3) has a voltage Vref+ΔV similar to the reference voltage Vref in the image data writing process. Here, a potential difference Vgs between the first node N1 and the second node N2 of each driving transistor DT is Vdata−(Vref+ΔV).

During the 1H period directly before the fake data insertion driving period, e.g., during the rear period portion of the turn-on level voltage period of the two gate signals SCAN and SENSE in the sub-pixel row R(n+4) (that does not overlap the front period portion of the turn-on level voltage period of the two gate signals SCAN and SENSE in the next sub-pixel row R(n+5)), the voltage Vs of the second node N2 of the driving transistor DT of each of the sub-pixels included in the sub-pixel row R(n+4) may be Vref+Δ(V/2) lower than Vref+ΔV.

Thus, the potential difference Vgs (Vgs(4)) between the first node N1 and the second node N2 of each driving transistor DT is Vdata−(Vref+Δ(V/2)), and may be increased from the potential difference Vdata−(Vref+ΔV) of the previous period.

Figure 8:
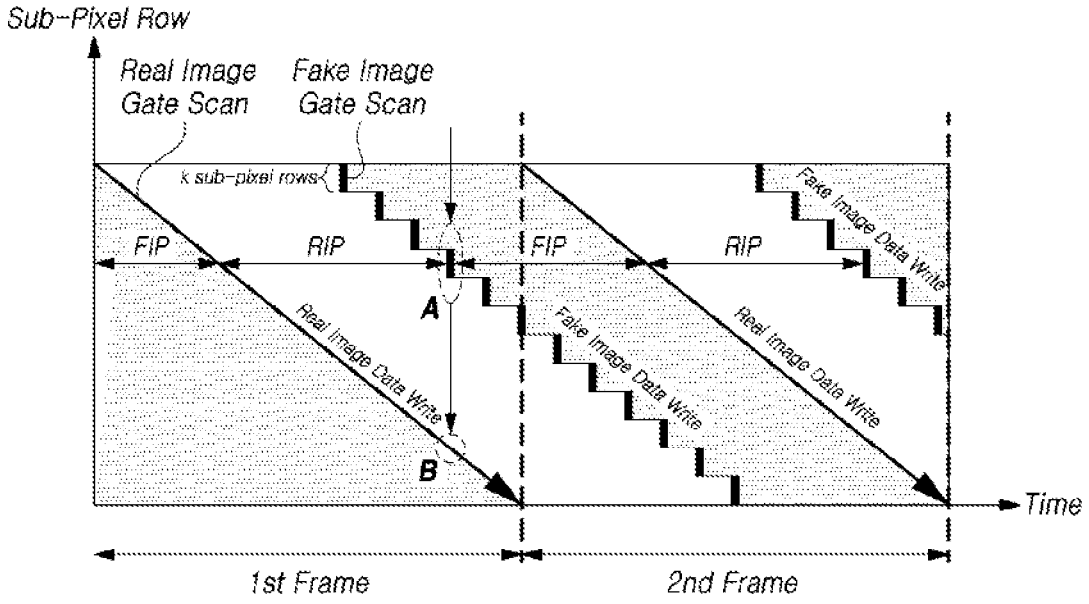
FIGS. 8 and 9 are diagrams for describing the principle of the fake data insertion driving performed by the display device according to aspects of the present disclosure.
Figure 9:
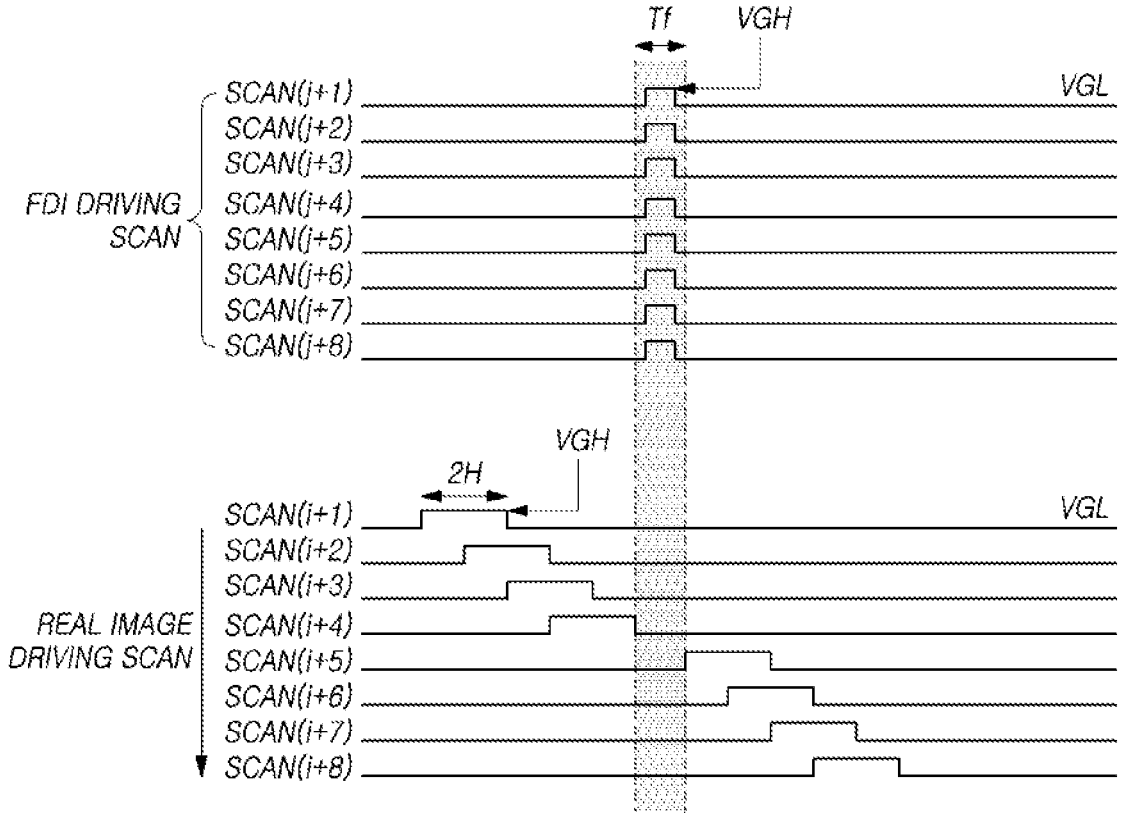

FIGS. 8 and 9 are diagrams for describing the principle of the fake data insertion (FDI) driving performed by the display device 100 according to the aspects of the present disclosure. However, it is assumed that the fake data insertion driving is performed simultaneously in eight sub-pixel rows. That is, the case in which k=8 is assumed.

During one frame time, each of the scan signals SCAN(i+1) to SCAN(i+8) and SCAN(j+1) to SCAN(j+8) may have a turn-on level voltage period and a turn-off level voltage period.

The turn-on level voltage period of each of the SCAN(i+1) to SCAN(i+8) and SCAN(j+1) to SCAN(j+8) has a turn-on level voltage VGH capable of turning on the scan transistor SCT, and the turn-off level voltage period of each of the SCAN(i+1) to SCAN(i+8) and SCAN(j+1) to SCAN(j+8) has a turn-off level voltage VGL capable of turning off the scan transistor SCT. For example, when the scan transistor SCT is an n-type, the turn-on level voltage VGH may be higher than the turn-off level voltage VGL, and when the scan transistor SCT is a p-type, the turn-on level voltage VGH may be lower than the turn-off level voltage VGL. In the present specification and drawings, the case in which the scan transistor SCT is an n-type is described as an example.

Referring to FIGS. 8 and 9, the gate driving circuit 130 outputs (i+1)th to (i+4)th scan signals SCAN(i+1) to SCAN(i+4) sequentially having a turn-on level voltage period to (i+1)th to (i+4)th scan lines SCL according to the overlap driving method.

Referring to FIGS. 8 and 9, after the (i+4)th scan signal SCAN(i+4) having a turn-on level voltage period is output from the gate driving circuit 130, the fake data insertion driving is performed according to the predetermined driving timing rule.

Accordingly, the gate driving circuit 130 stops outputting the scan signal to the (i+5)th scan signal line SCL, which corresponds to a point B and is next to the (i+4)th scan signal line SCL, and subsequent scan signal lines SCL.

During a fake data insertion driving period Tf, the gate driving circuit 130 outputs eight scan signals SCAN(j+1) to SCAN(j+8) having a turn-on level voltage period to eight scan signal lines SCL disposed in eight sub-pixel rows, corresponding to a region A, at the same timing. Accordingly, the scan transistors SCT of the sub-pixels SP connected to the eight scan signal lines SCL are turned on, so that the fake data voltage Vfake output from the data driving circuit 120 is supplied to the sub-pixels SP in the eight sub-pixel rows corresponding to the region A.

After the fake data insertion driving period Tf, the gate driving circuit 130 resumes outputting the gate signal for the real display driving and outputs (i+5)th to (i+8)th scan signals SCAN(i+5) to SCAN(i+8) sequentially having a turn-on level voltage period to (i+5)th to (i+8)th scan signal lines SCL according to the overlap driving method.

Referring to FIG. 8, the sub-pixels SP of the region A and the sub-pixels SP at the point B are connected to the same one data line DL. The data driving circuit 120 should not simultaneously output the real image data voltage Vdata and the fake data voltage Vfake to one data line DL.

Thus, during the fake data insertion driving period Tf, the gate driving circuit 130 stops outputting the scan signal to the (i+5)th scan signal line SCL, corresponding to the point B, and subsequent scan signal lines SCL.

In other words, during the fake data insertion driving period Tf, the turn-on level voltage period of the (i+4)th scan signal SCAN(i+4) and the turn-on level voltage period of the (i+5)th scan signal SCAN(i+5) are spaced apart from each other so as not to overlap each other, thereby securing the timing during which the fake data voltage Vfake is supplied to the sub-pixels SP of the region A.

Figure 10:
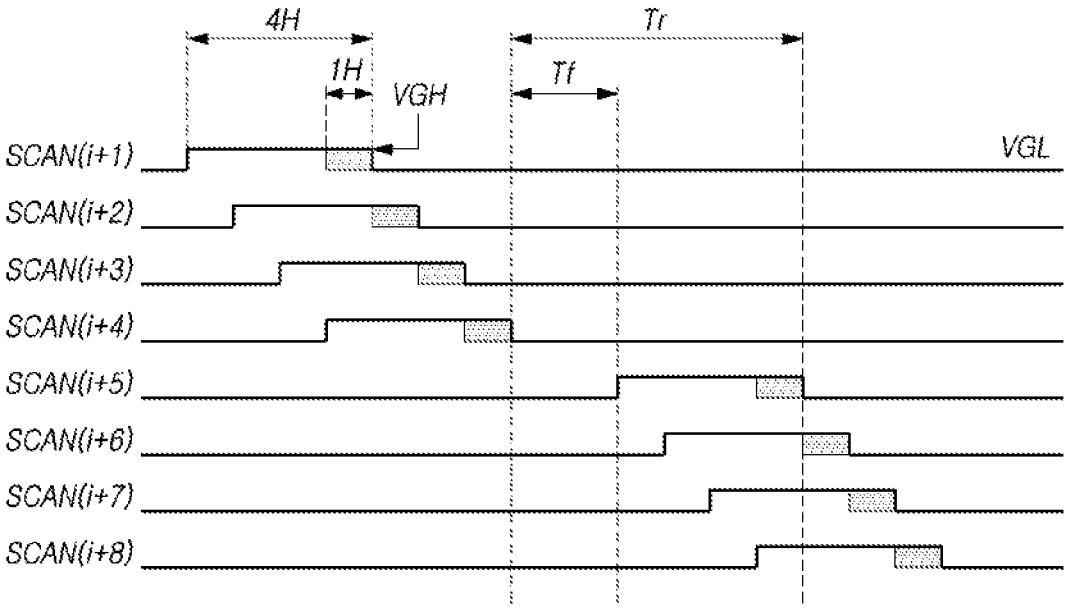
FIG. 10 is a timing diagram in the fake data insertion driving when the display device according to aspects of the present disclosure is implemented with high resolution.

FIG. 10 is a timing diagram in the fake data insertion (FDI) driving when the display device 100 according to the aspects of the present disclosure is implemented with high resolution.

When the display panel 110 is implemented with high resolution, within a predetermined size, more sub-pixels SP are disposed, and more data lines DL and gate lines SCL and SENL are disposed. When the display panel 110 is implemented with high resolution, more sub-pixels SP must be driven within the predetermined one frame time, and thus the charging time of the storage capacitor Cst of each of the sub-pixels SP is inevitably insufficient.

Accordingly, in order to implement the display device 100 according to the aspects of the present disclosure in a high resolution, the length of the turn-on level voltage period of each of the scan signals SCAN(i+1) to SCAN(i+8) may be extended to be greater than one horizontal time (1H).

For example, as shown in FIG. 10, in order to implement the display device 100 according to the aspects of the present disclosure in a high resolution, the length of the turn-on level voltage period of each of the scan signals SCAN(i+1) to SCAN(i+8) may be set to four horizontal times (4H) or more.

Referring to FIG. 10, the rear 1H period portion of the turn-on level voltage period of each of the scan signals SCAN(i+1) to SCAN(i+8) corresponds to a period for the image data writing.

Referring to FIG. 10, when the time length of the turn-on level voltage period of each of the scan signals SCAN(i+1) to SCAN(i+8) is set to be greater for high-resolution implementation, a time interval Tr between the timing at which the real image data writing, directly before the fake data insertion driving period Tf, is performed and the timing at which the real image data writing, directly after the fake data insertion driving period Tf, is performed is inevitably increased.

The time interval Tr between the timing at which the real image data writing, directly before the fake data insertion driving period Tf, is performed and the timing at which the real image data writing, directly after the fake data insertion driving period Tf, is performed corresponds to the image display delay caused by the fake data insertion driving. In the high-resolution implementation, the image display delay caused by the fake data insertion driving is inevitably increased, and this may be a factor that degrades image quality.

The aspects of the present disclosure propose a new panel structure and a driving method utilizing the same that may fundamentally eliminate the image display delay that is inevitably generated when the overlap driving for improving a charging rate and the fake data insertion driving for preventing afterimages and improving moving picture response time are performed together.

By using the new panel structure and the driving method utilizing the same according to the aspects of the present disclosure, even when the overlap driving and the fake data insertion driving are simultaneously performed for high-resolution implementation, the image display delay caused by the fake data insertion driving may be fundamentally eliminated. Hereinafter, the new panel structure and the new driving method utilizing the same according to the aspects of the present disclosure will be described.

Figure 11:
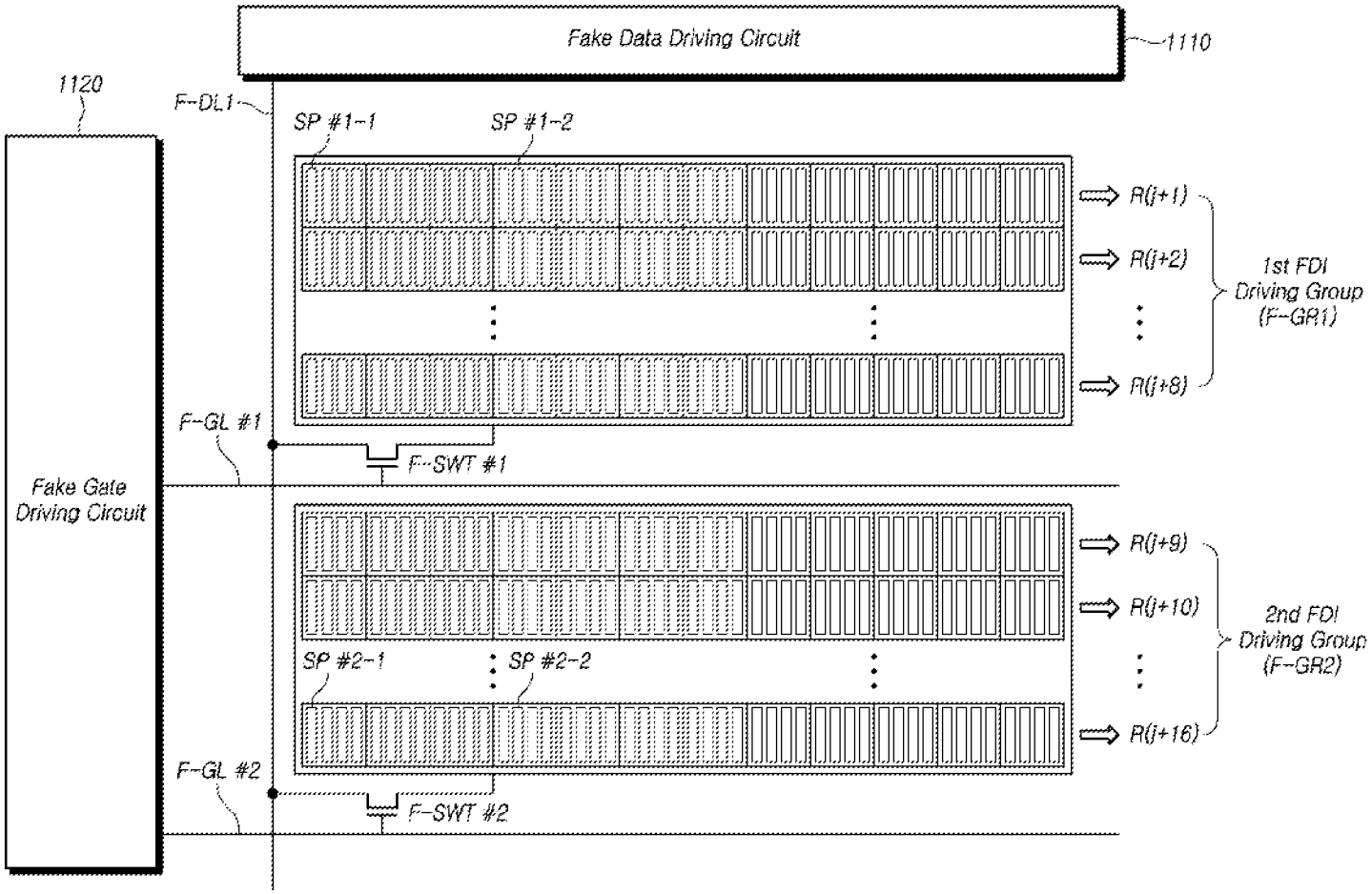
FIGS. 11 and 12 are diagrams illustrating a fake data insertion driving system of the display device according to aspects of the present disclosure.
Figure 12:
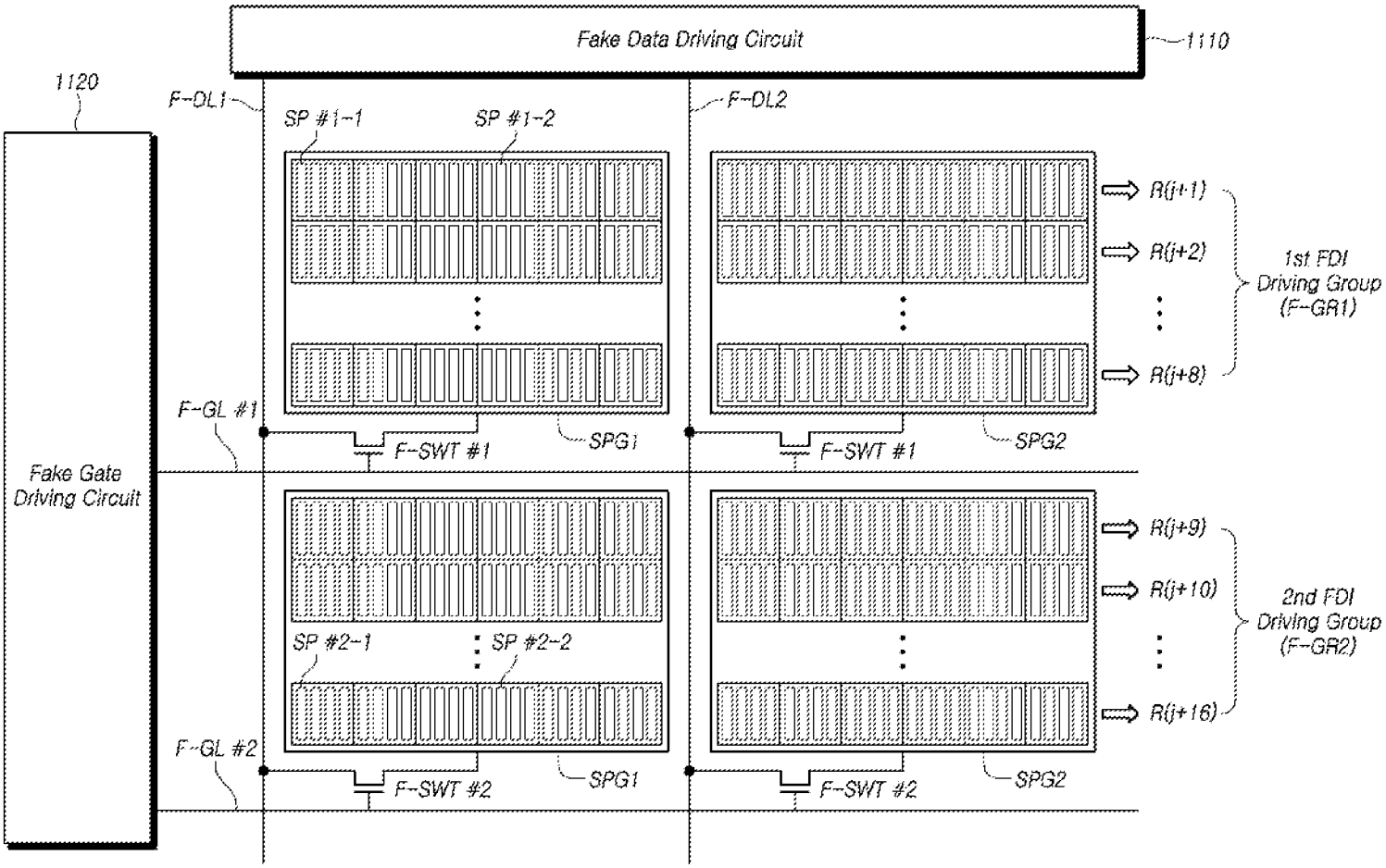
Figure 13:
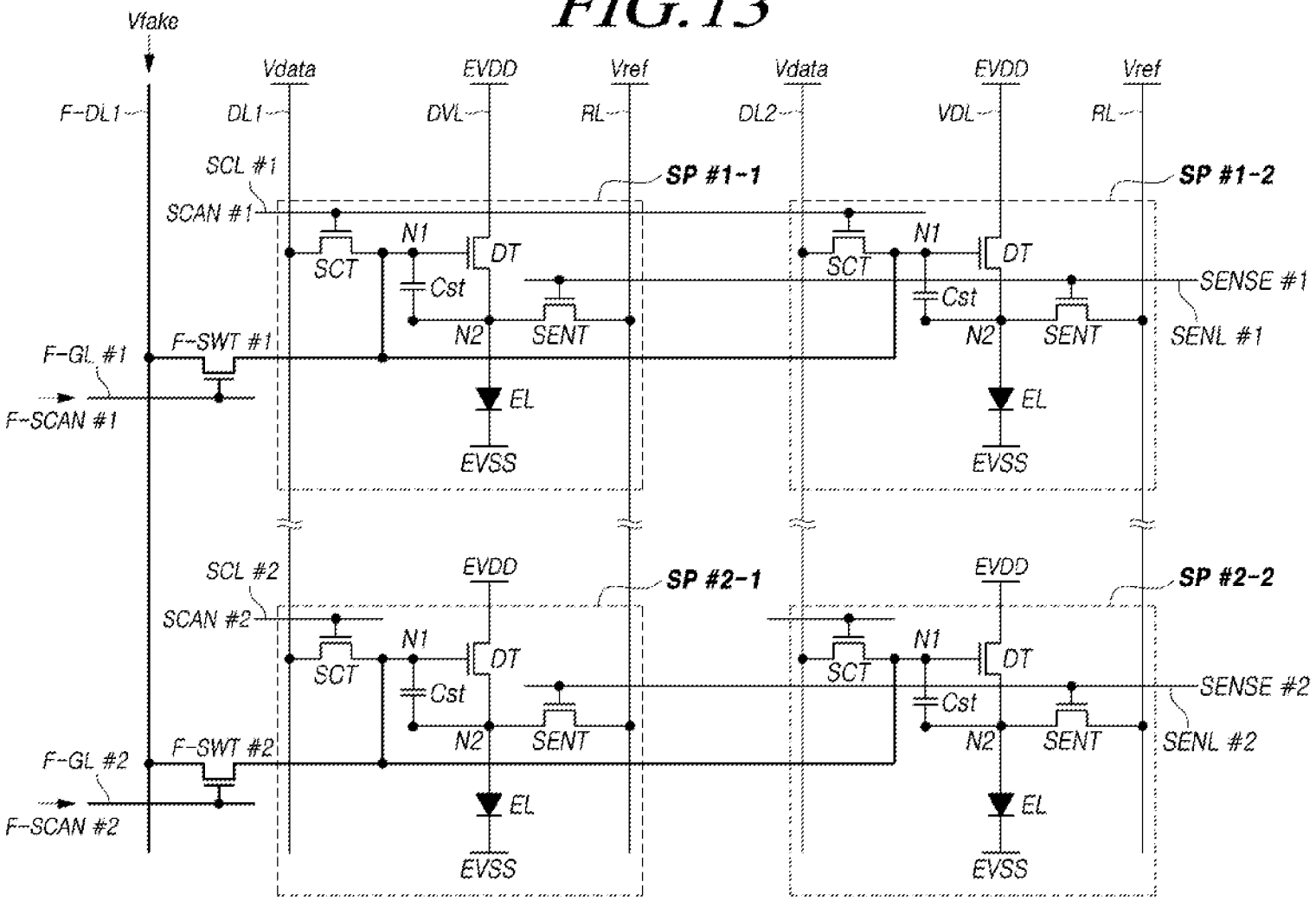
FIG. 13 illustrates an equivalent circuit of a portion of the fake data insertion driving system of the display device according to aspects of the present disclosure.
Figure 14:
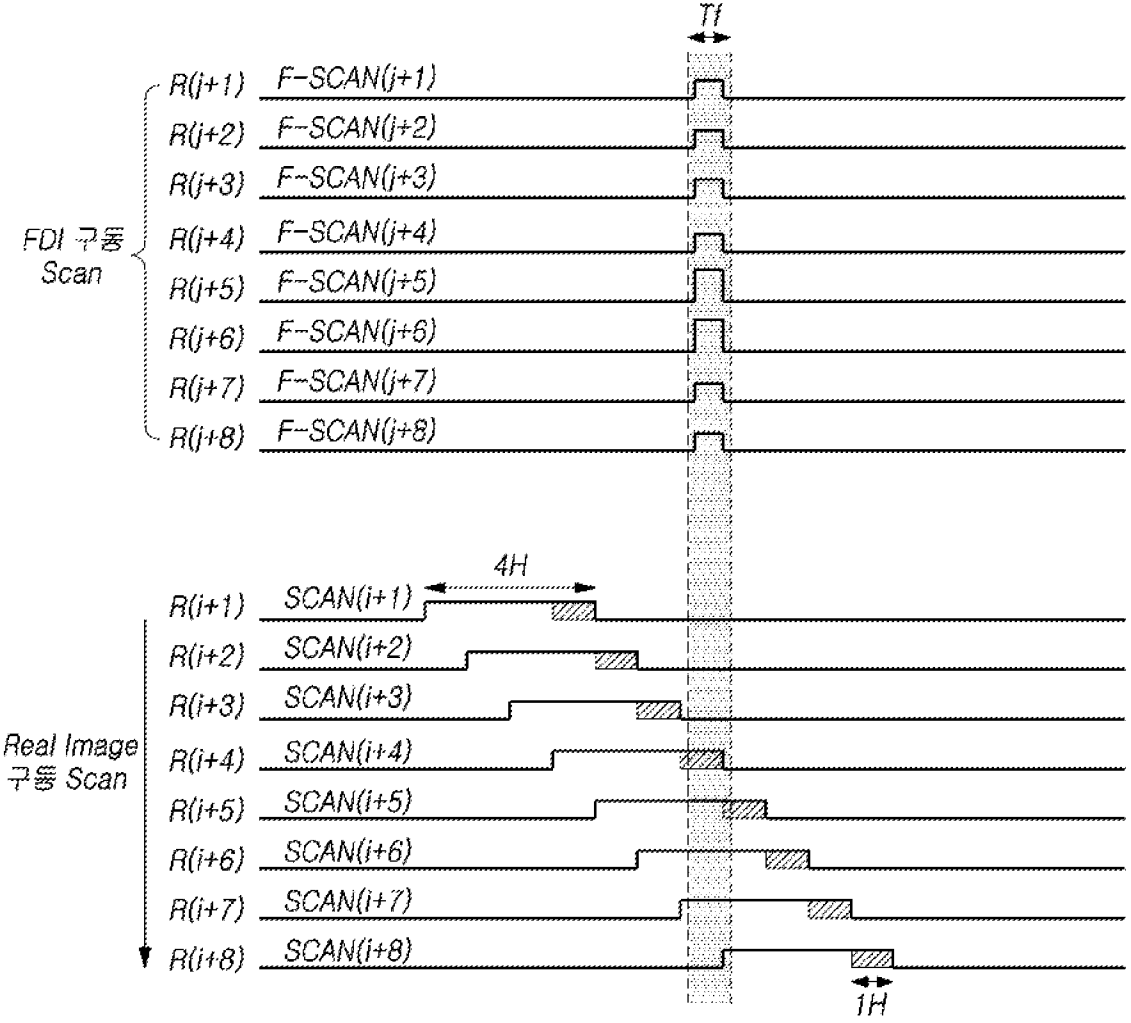
FIG. 14 is a set of diagrams illustrating the scan timing for fake data insertion driving and the scan timing for real image driving in the case that the fake data insertion driving system of the display device according to aspects of the present disclosure is used.

FIGS. 11 and 12 are diagrams illustrating a fake data insertion driving system of the display device 100 according to the aspects of the present disclosure. FIG. 13 illustrates an equivalent circuit of a portion of the fake data insertion driving system of the display device 100 according to the aspects of the present disclosure. FIG. 14 is a set of diagrams illustrating scan timing for the fake data insertion driving and scan timing for real image driving in the case that the fake data insertion driving system of the display device 100 according to the aspects of the present disclosure is used.

Referring to FIGS. 11 to 13, in order to fundamentally eliminate the image display delay that is inevitably generated when the overlap driving for improving a charging rate and the fake data insertion driving for preventing afterimages and improving moving picture response time are performed together, the display device 100 according to the aspects of the present disclosure may include new panel structures F-DL1, F-DL2, F-GL #1, F-GL #2, F-SWT #1, F-SWT #2, and the like and driving circuits 1110 and 1120 for driving the same.

The display device 100 according to the aspects of the present disclosure may include: a display panel 110 including a plurality of sub-pixels SP connected to a plurality of data lines DL and a plurality of scan signal lines SCL, wherein each of the plurality of sub-pixels SP includes a light-emitting element ED, a driving transistor DT configured to drive the light-emitting element ED, a scan transistor SCT configured to control the connection between a first node N1 of the driving transistor DT and the data line DL in response to a scan signal SCAN supplied through the scan signal line SCL, a capacitor Cst connected between the first node N1 and a second node N2 of the driving transistor DT; a data driving circuit 120 for driving the plurality of data lines DL; a gate driving circuit 130 for driving the plurality of scan signal lines SCL; and the like.

Referring to FIG. 14, the plurality of sub-pixels SP are arranged in the form of a matrix to form a plurality of sub-pixel rows ( . . . , R(j+1) to R(j+8), . . . , R(i+1) to R(i+8), and . . . ).

The gate driving circuit 130 may sequentially apply a plurality of scan signals SCAN (i+1) to SCAN (i+8) sequentially having a turn-on level voltage period to the plurality of scan signal lines SCL.

Since the overlap driving is performed, the turn-on level voltage periods of the scan signals SCAN (i+1) to SCAN (i+8), which are applied to two adjacent scan signal lines SCL among the plurality of scan signal lines SCL respectively corresponding to the plurality of sub-pixel rows ( . . . , R(j+1) to R(j+8), . . . , R(i+1) to R(i+8), and . . . ), may partially overlap each other.

Referring to FIG. 14, the display device 100 according to the aspects of the present disclosure may not stop scanning for the real image driving in order to perform the fake data insertion driving. The display device 100 according to the aspects of the present disclosure may independently perform the real display driving for displaying a real image and the fake display driving (fake data insertion driving) for displaying a fake image.

Referring to FIG. 14, since the real display driving and the fake display driving are performed independently, in a first frame time, when a first sub-pixel SP, which is disposed in a first sub-pixel row R(i+4) among the plurality of sub-pixel rows ( . . . , R(j+1) to R(j+8), . . . , R(i+1) to R(i+8), and . . . ), receives image data voltage Vdata for displaying a real image through a first data line DL, second sub-pixels SP, which are disposed in k second sub-pixel rows R(i+1) to R(i+8) (k is a natural number of two or more) different from the first sub-pixel row R(i+4) among the plurality of sub-pixel rows ( . . . , R(j+1) to R(j+8), . . . , R(i+1) to R(i+8), and . . . ), may receive a fake data voltage Vfake for displaying a fake image different from the real image.

Referring to FIG. 14, since the real display driving and the fake display driving are performed independently, in the first frame time, while a scan signal SCAN(i+4) having a turn-on level voltage is applied to the scan signal line SCL, which is disposed in the first sub-pixel row R(i+4) among the plurality of sub-pixel rows ( . . . , R(j+1) to R(j+8), . . . , R(i+1) to R(i+8), and . . . ), second sub-pixels SP, which are disposed in k second sub-pixel rows R(j+1) to R(j+8) (k is a natural number of two or more, and k=8 in the case of FIGS. 11 to 14) different from the first sub-pixel row R(i+4) among the plurality of sub-pixel rows ( . . . , R(j+1) to R(j+8), . . . , R(i+1) to R(i+8), and . . . ), may receive the fake data voltage Vfake for displaying a fake image different from the real image.

Referring to FIG. 14, during a fake data insertion (FDI) driving period Tf, the first sub-pixels SP disposed in the first sub-pixel row R(i+4) may receive the image data voltage Vdata for displaying a real image through the first data line DL.

Referring to FIG. 14, during the fake data insertion (FDI) driving period Tf, the scan signal SCAN(i+4) having a turn-on level voltage may be applied to the scan signal line SCL disposed in the first sub-pixel row R(i+4).

Here, the fake data voltage Vfake may be a black data voltage, a low grayscale data voltage, a monochrome data voltage, or the like.

The second sub-pixels SP disposed in the k second sub-pixel rows R(j+1) to R(j+8) may include sub-pixels SP connected to the first data line DL that transmits the image data voltage Vdata for displaying a real image to the first sub-pixel SP.

The k second sub-pixel rows R(j+1) to R(j+8) described above may be included in the same first fake driving group F-GR1 that displays the fake image at the same time.

Referring to FIGS. 11 to 14, the display panel 110 of the display device 100 according to the aspects of the present disclosure may further include a first fake data line (F-DL1 in the case of FIG. 11, and F-DL1 and F-DL2 in the case of FIG. 12) corresponding to the first fake driving group F-GR1 and transmitting the fake data voltage Vfake, a first fake gate line F-GL #1 corresponding to the first fake driving group F-GR1 and transmitting fake gate signals F-SCAN(j+1) to F-SCAN(j+8), and a first fake switching transistor F-SWT #1 corresponding to the first fake driving group F-GR1.

Referring to FIGS. 11 to 13, a gate node of the first fake switching transistor F-SWT #1 is electrically connected to the first fake gate line F-GL #1.

Referring to FIGS. 11 to 13, a source node or drain node of the first fake switching transistor F-SWT #1 is electrically connected to the first fake data line (F-DL1 in the case of FIG. 11, and F-DL1 and F-DL2 in the case of FIG. 12).

Referring to FIGS. 11 to 13, the source node or drain node of the first fake switching transistor F-SWT #1 is electrically connected to all of first nodes N1 of driving transistors DT of the second sub-pixels SP disposed in the 8 (k=8) second sub-pixel rows R (j+1) to R(j+8), which are included in the first fake driving group F-GR1.

Referring to FIGS. 11 and 12, k sub-pixel rows R(j+9) to R(j+16) adjacent to the k second sub-pixel rows R(j+1) to R(j+8) included in the first fake driving group F-GR1 are included in the same second fake driving group F-GR2 that simultaneously displays a fake image at different timing from the first fake driving group F-GR1.

The display panel 110 may further include a second fake data line (F-DL1 in the case of FIG. 11, and F-DL1 and F-DL2 in the case of FIG. 12) corresponding to the second fake driving group F-GR2 and transmitting the fake data voltage Vfake, a second fake gate line F-GL #2 corresponding to the second fake driving group F-GR2 and transmitting the fake gate signals, and a second fake switching transistor F-SWT #2 corresponding to the second fake driving group F-GR2.

The second fake data line (F-DL1 in the case of FIG. 11, and F-DL1 and F-DL2 in the case of FIG. 12) corresponding to the second fake driving group F-GR2 and the first fake data line (F-DL1 in the case of FIG. 11, and F-DL1 and F-DL2 in the case of FIG. 12) corresponding to the first fake driving group F-GR1 may be different from each other or may be the same as shown in FIGS. 11 and 12.

The second fake gate line F-GL #2 of the second fake driving group F-GR2 may be different from the first fake gate line F-GL #1 of the first fake driving group F-GR1.

The second fake gate line F-GL #2 of the second fake driving group F-GR2 may be the same as the first fake gate line F-GL #1 of the first fake driving group F-GR1. In this case, the first fake gate line F-GL #1, which is the same as the second fake gate line F-GL #2, may be disposed between the first fake driving group F-GR1 and the second fake driving group F-GR2.

Referring to FIGS. 11 and 12, the display device 100 according to the aspects of the present disclosure may further include a fake data driving circuit 1110 configured to output a fake data voltage Vfake and a fake gate driving circuit 1120 configured to output a fake gate signal.

The fake data driving circuit 1110 may be included in the data driving circuit 120 or may be implemented separately from the data driving circuit 120. The fake gate driving circuit 1120 may be included in the gate driving circuit 130 or may be implemented separately from the gate driving circuit 130.

As described above, the k second sub-pixel rows R(j+1) to R(j+8) may be included in the same first fake driving group F-GR1 that displays the fake image at the same time.

Referring to FIG. 11, one driving structure set F-DL1, F-GL #1, and F-SWT #1 is disposed in the first fake driving group F-GR1.

In contrast, two or more driving structure sets may be disposed in the first fake driving group F-GR1. In this case, the first fake driving group F-GR1 may be divided into two or more sub-pixel groups.

Referring to the example of FIG. 11, the first fake driving group F-GR1 is divided into two sub-pixel groups SPG1 and SGP2. The driving structure set is disposed in each of the two sub-pixel groups SPG1 and SPG2.

Referring to FIG. 12, the k second sub-pixel rows R(j+1) to R(j+8) included in the first fake driving group F-GR1 include a first sub-pixel group SPG1 and a second sub-pixel group SPG2.

Referring to FIG. 12, the data lines DL connected to the second sub-pixels SP included in the first sub-pixel group SPG1 and the data lines DL connected to the second sub-pixels SP included in the second sub-pixel group SPG2 are different from each other.

Referring to FIG. 12, the display panel 110 may include a first fake data line F-DL1 corresponding to the first sub-pixel group SPG1 in the first fake driving group F-GR1 and transmitting the fake data voltage Vfake, and a second fake data line F-DL2 corresponding to the second sub-pixel group SPG2 in the first fake driving group F-GR1 and transmitting the fake data voltage Vfake.

Referring to FIG. 12, the display panel 110 may include a first fake gate line F-GL #1 corresponding to the first fake driving group F-GR1 and transmitting the fake gate signal.

Referring to FIG. 12, the display panel 110 may further include a first fake switching transistor F-SWT #1 corresponding to the first sub-pixel group SPG1 in the first fake driving group F-GR1 and a second fake switching transistor F-SWT #2 corresponding to the second sub-pixel group SPG2 in the first fake driving group F-GR1.

Referring to FIGS. 12 and 13, a gate node of the first fake switching transistor F-SWT #1 is electrically connected to the first fake gate line F-GL #1, a source node or drain node of the first fake switching transistor F-SWT #1 is electrically connected to the first fake data line F-DL1, the source node or drain node of the first fake switching transistor F-SWT #1 is electrically connected to all of first nodes N1 of driving transistors DT of second sub-pixels SP included in the first sub-pixel group SPG1 in the first fake driving group F-GR1.

Referring to FIGS. 12 and 13, a gate node of the second fake switching transistor F-SWT #2 is electrically connected to the first fake gate line F-GL #1, a source node or drain node of the second fake switching transistor F-SWT #2 is electrically connected to the second fake data line F-DL2, and the source node or drain node of the second fake switching transistor F-SWT #2 is electrically connected to all of first nodes N1 of driving transistors DT of second sub-pixels SP included in the second sub-pixel group SPG2 in the first fake driving group F-GR1.

Each of the plurality of sub-pixels SP may further include a sensing transistor SENT configured to control the connection between a reference line and a second node N2 of the driving transistor DT in response to a sensing signal SENSE supplied through the sensing signal line SENL.

The sensing signal SENSE applied to the sensing signal line SENL may have the same signal waveform as the scan signal SCAN applied to the scan signal line SCL.

The turn-on level voltage period of the plurality of scan signals SCAN (i+1) to SCAN (i+8) may be greater than one horizontal time, for high-resolution implementation. For example, as shown in FIG. 14, the turn-on level voltage period of each of the plurality of scan signals SCAN (i+1) to SCAN (i+8) may be four horizontal times (4H). A rear period (1H) portion of the turn-on level voltage period of each of the plurality of scan signals SCAN (i+1) to SCAN (i+8) is an image data writing period.

FIG. 13 is a diagram illustrating an equivalent circuit of any two sub-pixels SP #1-1 and SP #1-2 among the sub-pixels SP disposed in the eight sub-pixel rows R(j+1) to R(j+8) included in the first fake driving group F-GR1 and any two sub-pixels SP #2-1 and SP #2-2 among the sub-pixels SP disposed in the eight sub-pixel rows R(j+9) to R(j+16) included in the second fake driving group F-GR2 along with a fake data insertion driving circuit.

Referring to FIG. 13, the driving circuit for the first fake driving group F-GR1 includes a first fake data line F-DL1, a first fake gate line F-GL #1, and a first fake switching transistor F-SWT #1.

Referring to FIG. 13, the driving circuit for the second fake driving group F-GR2 includes the first fake data line F-DL1, a second fake gate line F-GL #2, and a second fake switching transistor F-SWT #2.

Referring to FIG. 13, sub-pixels SP #1-1, SP #1-2, SP #2-1, and SP #2-2 each include all components ED, DT, SCT, SENT, and Cst, required for driving the display, regardless of the driving circuits for the first fake driving group F-GR1 and the second fake driving group F-GR2.

Referring to FIG. 13, the first fake switching transistor F-SWT #1 is controlled by the fake gate signal F-SCAN #1 (F-SCAN (j+1) in FIG. 14) supplied through the first fake gate line F-GL #1.

Referring to FIG. 13, when the first fake switching transistor F-SWT #1 is turned on in response to the fake gate signal F-SCAN #1, the first fake switching transistor F-SWT #1 transfers the fake data voltage Vfake supplied from the first fake data line F-DL1 to a first node N1 of the driving transistor DT of each of the sub-pixels SP #1-1, SP #1-2, and . . . included in the first fake driving group F-GR1.

Referring to FIG. 13, the second fake switching transistor F-SWT #2 is controlled by the fake gate signal F-SCAN #2 supplied through the second fake gate line F-GL #2.

Referring to FIG. 13, when the second fake switching transistor F-SWT #2 is turned on in response to the fake gate signal F-SCAN #2, the second fake switching transistor F-SWT #2 transfers the fake data voltage Vfake supplied from the first fake data line F-DL1 to a first node N1 of the driving transistor DT of each of the sub-pixels SP #2-1, SP #2-2, and . . . included in the second fake driving group F-GR2.

In the display device 100 according to the aspects of the present disclosure, the first fake driving group F-GR1 is a driving group in which the fake data insertion driving is performed in the same manner, and may be driven by one first fake switching transistor F-SWT #1 as shown in FIG. 11.

In this case, all the sub-pixels SP included in the first fake driving group F-GR1 may receive the fake data voltage Vfake through one first fake switching transistor F-SWT #1.

In the display device 100 according to the aspects of the present disclosure, the first fake driving group F-GR1 may be divided into two or more sub-pixel groups SPG1, SPG2, and . . . .

When the first fake driving group F-GR1 is divided into the two or more sub-pixel groups SPG1, SPG2, and . . . , a corresponding first fake switching transistor F-SWT #1 may be disposed for each of the two or more sub-pixel groups SPG1, SPG2, and . . . obtained by dividing the first fake driving group F-GR1.

Referring to FIG. 12, the first fake driving group F-GR1 may be driven by two first fake switching transistors F-SWT #1. In this case, the first fake driving group F-GR1 is divided into two sub-pixel groups SPG1 and SPG2, and the two sub-pixel groups SPG1 and SPG2 may be driven by the two first fake switching transistors F-SWT #1, respectively.

In this case, the two sub-pixel groups SPG1 and SPG2 obtained by dividing the first fake driving group F-GR1 may each be supplied with the fake data voltage Vfake through the corresponding first fake switching transistor F-SWT #1.

In the display device 100 according to the aspects of the present disclosure, the first fake driving group F-GR1 may be divided into two or more sub-pixel groups SPG1, SPG2, and . . . .

Figure 15:
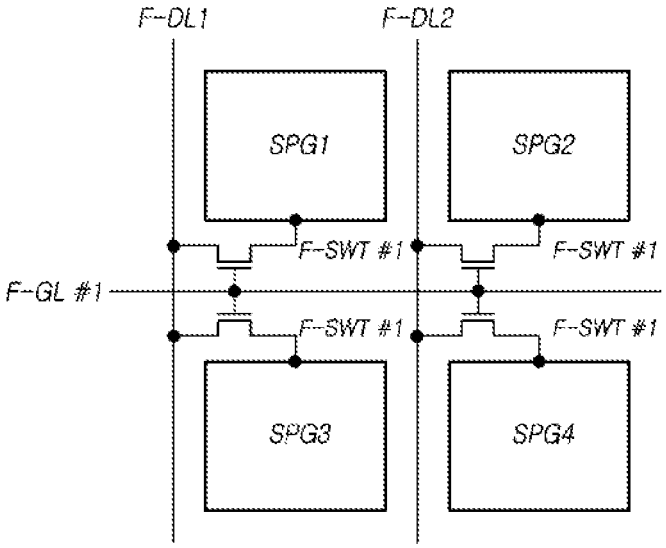
FIG. 15 is a diagram illustrating a structure in which a plurality of sub-pixel groups of a first fake driving group share a first fake gate line in the display panel of the display device according to aspects of the present disclosure.
Figure 16:
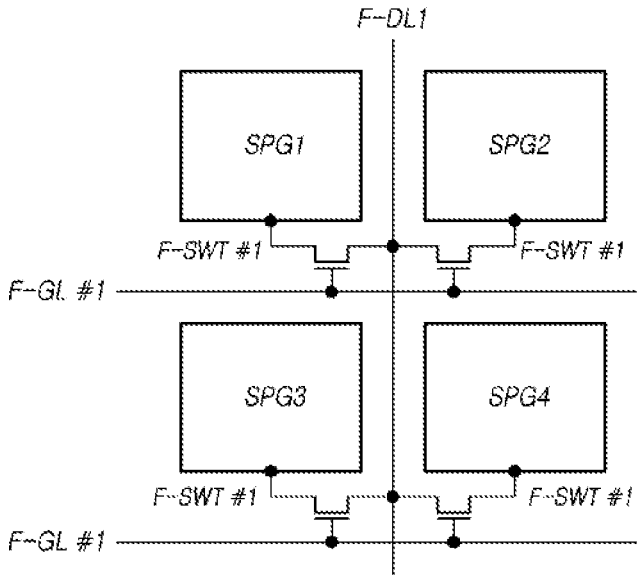
FIG. 16 is a diagram illustrating a structure in which the plurality of sub-pixel groups of the first fake driving group share a first fake data line in the display panel of the display device according to aspects of the present disclosure.

FIG. 15 is a diagram illustrating a structure in which a plurality of sub-pixel groups SPG1 to SPG4 of the first fake driving group F-GR1 share the first fake gate line F-GL #1 in the display panel 110 of the display device 100 according to the aspects of the present disclosure, and FIG. 16 is a diagram illustrating a structure in which the plurality of sub-pixel groups SPG1 to SPG4 of the first fake driving group F-GR1 share the first fake data line F-DL1 in the display panel 110 of the display device 100 according to the aspects of the present disclosure.

Referring to FIGS. 15 and 16, the first fake driving group F-GR1 is divided into four sub-pixel groups SPG1, SPG2, SPG3, and SPG4. A corresponding first fake switching transistor F-SWT #1 may be disposed for each of the four sub-pixel groups SPG1, SPG2, SPG3, and SPG4.

In this case, the four sub-pixel groups SPG1, SPG2, SPG3, and SPG4 obtained by dividing the first fake driving group F-GR1 may receive the fake data voltage Vfake through the four first fake switching transistors F-SWT #1, respectively.

The display panel 110 may include a first fake gate line F-GL #1 and a first fake data line F-DL1 corresponding to each of the four sub-pixel groups SPG1, SPG2, SPG3, and SPG4 obtained by dividing the first fake driving group F-GR1.

In contrast, the four sub-pixel groups SPG1, SPG2, SPG3, and SPG4 obtained by dividing the first fake driving group F-GR1 may share one or more of the first fake gate line F-GL #1 and the first fake data line F-DL1.

This will be described in more detail with reference to FIGS. 15 and 16.

Referring to FIGS. 15 and 16, in the four sub-pixel groups SPG1, SPG2, SPG3, and SPG4 obtained by dividing the first fake driving group F-GR1, a first sub-pixel group SPG1 and a second sub-pixel group SPG2 are groups in which the same scan signal lines SCL are disposed, and a third sub-pixel group SPG3 and a fourth sub-pixel group SPG4 are groups in which the same scan signal lines SCL are disposed.

Referring to FIGS. 15 and 16, in the four sub-pixel groups SPG1, SPG2, SPG3, and SPG4 obtained by dividing the first fake driving group F-GR1, the first sub-pixel group SPG1 and the third sub-pixel group SPG3 are groups for which the same data lines DL are disposed, and the second sub-pixel group SPG2 and the fourth sub-pixel group SPG4 are groups for which the same data lines DL are disposed.

Referring to FIGS. 15 and 16, the first to fourth sub-pixel groups SPG1, SPG2, SPG3, and SPG4 obtained by dividing the first fake driving group F-GR1 are respectively supplied with the fake data voltage Vfake through the first fake switching transistors F-SWT #1.

Referring to FIGS. 15 and 16, the first fake switching transistors F-SWT #1 respectively corresponding to the first to fourth sub-pixel groups SPG1, SPG2, SPG3, and SPG4 obtained by dividing the first fake driving group F-GR1 may all be turned on and off at the same timing.

Referring to FIGS. 15 and 16, a source node or drain node of the first fake switching transistor F-SWT #1 corresponding to the first sub-pixel group SPG1 is electrically connected to a first node N1 of a driving transistor DT of each of all the sub-pixels SP included in the first sub-pixel group SPG1.

A source node or drain node of the first fake switching transistor F-SWT #1 corresponding to the second sub-pixel group SPG2 is electrically connected to a first node N1 of a driving transistor DT of each of all the sub-pixels SP included in the second sub-pixel group SPG2.

A source node or drain node of the first fake switching transistor F-SWT #1 corresponding to the third sub-pixel group SPG3 is electrically connected to a first node N1 of a driving transistor DT of each of all the sub-pixels SP included in the third sub-pixel group SPG3.

A source node or drain node of the first fake switching transistor F-SWT #1 corresponding to the fourth sub-pixel group SPG4 is electrically connected to a first node N1 of a driving transistor DT of each of all the sub-pixels SP included in the fourth sub-pixel group SPG4.

Referring to FIG. 15, the source node or drain node of the first fake switching transistor F-SWT #1 corresponding to the first sub-pixel group SPG1 and the source node or drain node of the first fake switching transistor F-SWT #1 corresponding to the third sub-pixel group SPG3 are electrically connected to the same first fake data line F-DL1.

Referring to FIG. 15, the source node or drain node of the first fake switching transistor F-SWT #1 corresponding to the second sub-pixel group SPG2 and the source node or drain node of the first fake switching transistor F-SWT #1 corresponding to the fourth sub-pixel group SPG4 are electrically connected to the same second fake data line F-DL2.

Referring to FIG. 15, the fake data driving circuit 1110 may simultaneously output the fake data voltage Vfake to the first fake data line F-DL1 and the second fake data line F-DL2.

Referring to FIG. 15, the four sub-pixel groups SPG1, SPG2, SPG3, and SPG4 obtained by dividing the first fake driving group F-GR1 share one first fake gate line F-GL #1

Accordingly, a gate node of the first fake switching transistor F-SWT #1 corresponding to the first sub-pixel group SPG1, a gate node of the first fake switching transistor F-SWT #1 corresponding to the second sub-pixel group SPG2, a gate node of the first fake switching transistor F-SWT #1 corresponding to the third sub-pixel group SPG3, and a gate node of the first fake switching transistor F-SWT #1 corresponding to the fourth sub-pixel group SPG4 may be commonly connected to one first fake gate line F-GL #1.

Referring to FIG. 16, the four sub-pixel groups SPG1, SPG2, SPG3, and SPG4 obtained by dividing the first fake driving group F-GR1 share one first fake data line F-DL1.

Accordingly, the source node or drain node of the first fake switching transistor F-SWT #1 corresponding to the first sub-pixel group SPG1, the source node or drain node of the first fake switching transistor F-SWT #1 corresponding to the second sub-pixel group SPG2, the source node or drain node of the first fake switching transistor F-SWT #1 corresponding to the third sub-pixel group SPG3, and the source node or drain node of the first fake switching transistor F-SWT #1 corresponding to the fourth sub-pixel group SPG4 are electrically connected to one first fake data line F-DL1.

Referring to FIG. 16, the gate node of the first fake switching transistor F-SWT #1 corresponding to the first sub-pixel group SPG1 and the gate node of the first fake switching transistor F-SWT #1 corresponding to the second sub-pixel group SPG2 are commonly connected to the one first fake gate line F-GL #1.

Referring to FIG. 16, the gate node of the first fake switching transistor F-SWT #1 corresponding to the third sub-pixel group SPG3 and the gate node of the first fake switching transistor F-SWT #1 corresponding to the fourth sub-pixel group SPG4 are commonly connected to the one first fake gate line F-GL #1.

The fake gate driving circuit 1120 may supply the fake gate signal through the first fake gate line F-GL #1 commonly connected to the gate nodes of the first fake switching transistor F-SWT #1 corresponding to the first sub-pixel group SPG1 and the first fake switching transistor F-SWT #1 corresponding to the second sub-pixel group SPG2, and the first fake gate line F-GL #1 commonly connected to the gate nodes of the first fake switching transistor F-SWT #1 corresponding to the third sub-pixel group SPG3 and the first fake switching transistor F-SWT #1 corresponding to the fourth sub-pixel group SPG4 at the same timing.

Accordingly, the first fake switching transistor F-SWT #1 corresponding to the first sub-pixel group SPG1, the first fake switching transistor F-SWT #1 corresponding to the second sub-pixel group SPG2, the first fake switching transistor F-SWT #1 corresponding to the third sub-pixel group SPG3, and the first fake switching transistor F-SWT #1 corresponding to the fourth sub-pixel group SPG4 may all be turned on or off at the same timing.

As described above, the display device 100 according to the aspects of the present disclosure may perform the real display driving when performing the fake data insertion driving.

Accordingly, the driving circuit on the data side of the display device 100 according to the aspects of the present disclosure may include the data driving circuit 120 configured to supply the image data voltage Vdata for displaying a real image to the first sub-pixel SP of the plurality of sub-pixels SP through the first data line DL during a first driving period, the fake data driving circuit 1110 configured to supply the fake data voltage Vfake for displaying a fake image different from the real image to the second sub-pixels SP different from the first sub-pixel SP among the plurality of sub-pixels SP through the fake data line F-DL during the first driving period, and the like.

When the image data voltage is supplied to the first sub-pixel SP, the fake data voltage Vfake may be supplied to the second sub-pixels SP.

The second sub-pixels SP supplied with the fake data voltage Vfake may include the sub-pixel SP connected to the first data line DL through which the image data voltage Vdata is transmitted.

For example, the fake image may be a black image, a low grayscale image, a monochrome image, or the like.

As described above, the display device 100 according to the aspects of the present disclosure may perform the real display driving when performing the fake data insertion driving.

Accordingly, the driving circuit on the gate side of the display device 100 according to the aspects of the present disclosure may include: the gate driving circuit 130 that outputs the scan signal (SCAN (i+4) according to the example of FIG. 14) having a turn-on level voltage period to a first scan signal line SCL connected to the first sub-pixel SP during the first driving period so that the image data voltage Vdata for displaying a real image is applied to the first node N1 of the driving transistor DT of the first sub-pixel SP among the plurality of sub-pixels SP; the fake gate driving circuit 1120 that outputs the fake gate signals F-SCAN(j+1) to F-SCAN(j+8) having a turn-on level voltage period to the fake gate line F-GL #1 corresponding to the second sub-pixels SP during the first driving period so that the fake data voltage Vfake for displaying a fake image different from the real image is applied to the first node N1 of the driving transistor DT of each of the second sub-pixels SP among the plurality of sub-pixels SP; and the like.

During the first driving period, the first nodes N1 of the driving transistors DT of the second sub-pixels SP may receive the fake data voltage Vfake from the fake data line F-DL1 through the fake switching transistor F-SWT #1 controlled by the fake gate signal supplied from the fake gate line F-GL #1.

During a driving period different from the first driving period, the first nodes N1 of the driving transistors DT of the second sub-pixels SP may be applied with the image data voltage Vdata from the data line DL through the scan transistor SCT controlled by the scan signal SCAN supplied from the scan signal line SCL.

For example, the fake image may be a black image, a low grayscale image, a monochrome image, or the like.

As described above, the display device 100 according to the aspects of the present disclosure may include a separate structure for the fake data insertion driving so as to independently perform the fake data insertion driving and the real display driving.

Accordingly, the display device 100 according to the aspects of the present disclosure may include a display panel 110 including a plurality of sub-pixels SP connected to a plurality of data lines DL and a plurality of scan signal lines SCL, a data driving circuit 120 for driving the plurality of data lines DL, and a gate driving circuit 130 for driving the plurality of scan signal lines SCL, and each of the plurality of sub-pixels SP may include a light-emitting element ED, a driving transistor DT configured to drive the light-emitting element ED, a scan transistor SCT configured to control the connection between a first node N1 of the driving transistor DT and the data line DL in response to a scan signal SCAN supplied through the scan signal line SCL, a capacitor Cst connected between the first node N1 and a second node N2 of the driving transistor DT.

The plurality of sub-pixels SP are arranged in the form of a matrix to form a plurality of sub-pixel rows and a plurality of sub-pixel columns, and the plurality of scan signal lines SCL may correspond to the plurality of sub-pixel rows, respectively.

The plurality of data lines DL correspond to the plurality of sub-pixels SP, respectively, and the plurality of sub-pixel rows may be grouped by k. Here, k is a natural number greater than or equal to 2.

The display panel 110 may further include one or more additional data lines F-DL1, and . . . that are disposed for each group (fake driving group), one additional gate line F-GL #1 disposed for one or two or more groups, and one or more additional switching transistors F-SWT #1 disposed for each group.

A specific data voltage that is not varied from frame to frame may be applied to the one or more additional data lines F-DL1, and . . . . Here, the specific data voltage is the fake data voltage Vfake.

Figure 17:
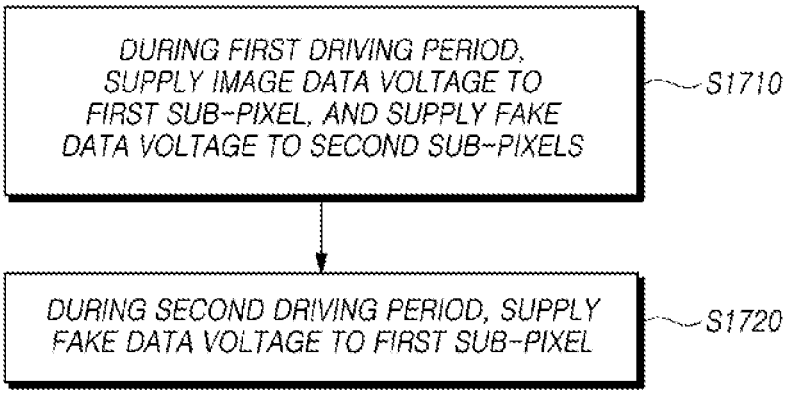
FIG. 17 is a flowchart for describing a driving method of the display device according to aspects of the present disclosure.

FIG. 17 is a flowchart for describing a driving method of the display device 100 according to the aspects of the present disclosure.

Referring to FIG. 17, the driving method of the display device 100 according to the aspects of the present disclosure may include a first process (S1710) of supplying an image data voltage Vdata for displaying a real image to a first sub-pixel SP of a plurality of sub-pixels SP through a first data line DL during a first driving period, and, a second process (S1720) of supplying a fake data voltage Vfake for displaying a fake image different from the real image to the first sub-pixel SP through a first fake data line F-DL1 during a second driving period different from the first driving period.

In the first process (S1710), during the first driving period, the fake data voltage Vfake may be supplied to second sub-pixels SP different from the first sub-pixel SP among the plurality of sub-pixels SP through a second fake data line F-DL2 different from the first fake data line F-DL1 or through the first fake data line F-DL1, and the second sub-pixels SP may include a sub-pixel SP connected to the first data line DL.

For example, the fake image may be a black image, a low grayscale image, a monochrome image, or the like.

According to the aspects of the present disclosure described above, a charging rate may be improved by performing the overlap driving of the sub-pixels, thereby improving image quality.

According to the aspect of the present disclosure, afterimages may be prevented and moving picture response time may be improved by performing the fake data insertion driving for displaying an image (fake image) different from real images between the real images, thereby improving moving picture quality.

According to the aspects of the present disclosure, by newly disposing a dedicated structure for the fake data insertion driving on the display panel, the overlap driving for improving a charging rate and the fake data insertion driving for preventing afterimages and improving moving picture response time may be performed independently.

According to aspects of the present disclosure, image display delay caused by the fake data insertion driving may be fundamentally prevented by simultaneously performing real image driving during the fake data insertion driving, thereby making it easier to implement high resolution.

The above description has been presented to enable any person skilled in the art to make and use the technical idea of the present disclosure, and has been provided in the context of a particular application and its requirements. Various modifications, additions, and substitutions to the described aspects will be readily apparent to those skilled in the art, and the general principles defined herein may be applied to other aspects and applications without departing from the spirit and scope of the present disclosure. The above description and the accompanying drawings provide an example of the technical idea of the present disclosure for illustrative purposes only. That is, the disclosed aspects are intended to illustrate the scope of the technical idea of the present disclosure. Thus, the scope of the present disclosure is not limited to the aspects shown, but is to be accorded the widest scope consistent with the claims. The scope of protection of the present disclosure should be construed based on the following claims, and all technical ideas within the scope of equivalents thereof should be construed as being included within the scope of the present disclosure.

What is claimed is:

1. A display device comprising:

a display panel including a plurality of sub-pixels connected to a plurality of data lines a first fake data line and a plurality of scan signal lines, wherein each of the plurality of sub-pixels includes a light-emitting element, a driving transistor configured to drive the light-emitting element, a scan transistor configured to control a connection between a corresponding one of the plurality of data lines and a first node of the driving transistor according to a scan signal supplied through the scan signal line, and a capacitor connected between the first node and a second node of the driving transistor;

a data driving circuit configured to drive the plurality of data lines; and a gate driving circuit configured to drive the plurality of scan signal lines, wherein the plurality of sub-pixels are arranged in a form of a matrix to form a plurality of sub-pixel rows, the gate driving circuit sequentially applies a plurality of scan signals sequentially having a turn-on level voltage period to the plurality of scan signal lines, turn-on level voltage periods of scan signals applied to two adjacent scan signal lines among the plurality of scan signal lines partially overlap each other, and when a first sub-pixel disposed in a first sub-pixel row among the plurality of sub-pixel rows receives an image data voltage for displaying a real image through a first data line of the plurality of data lines, second sub-pixels, which are disposed in k second sub-pixel rows (k is a natural number greater than or equal to 2) different from the first sub-pixel row among the plurality of sub-pixel rows, are simultaneously supplied with a fake data voltage through the first fake data line for displaying a fake image different from the real image and include a sub-pixel connected to the first data line.

2. The display device of claim 1, wherein the k second sub-pixel rows are included in one first fake driving group simultaneously displaying the fake image, and the display panel further includes the first fake data line corresponding to the first fake driving group and transmitting the fake data voltage, a first fake gate line corresponding to the first fake driving group and transmitting a fake gate signal, and a first fake switching transistor corresponding to the first fake driving group.

3. The display device of claim 2, wherein a gate node of the first fake switching transistor is electrically connected to the first fake gate line, a source node or drain node of the first fake switching transistor is electrically connected to the first fake data line, and the source node or drain node of the first fake switching transistor is electrically connected to all of the first nodes of the driving transistors of the second sub-pixels disposed in the k second sub-pixel rows included in the first fake driving group.

4. The display device of claim 2, wherein the plurality of sub-pixel rows include another k sub-pixel rows adjacent to the k second sub-pixel rows, the other k sub-pixel rows are included in a second fake driving group simultaneously displaying the fake image at a timing different from that of the first fake driving group, and the display panel further includes a second fake data line corresponding to the second fake driving group and transmitting the fake data voltage, a second fake gate line corresponding to the second fake driving group and transmitting the fake gate signal, and a second fake switching transistor corresponding to the second fake driving group.

5. The display device of claim 2, further comprising:

a fake data driving circuit configured to output the fake data voltage; and a fake gate driving circuit configured to output the fake gate signal.

6. The display device of claim 2, wherein when the first fake driving group is divided into two or more sub-pixel groups, the corresponding first fake switching transistor is disposed for each of the two or more sub-pixel groups, and the two or more sub-pixel groups share one or more of the first fake gate line and the first fake data line.

7. The display device of claim 1, wherein the fake data voltage is a black data voltage, a low grayscale data voltage, or a monochrome data voltage.

8. The display device of claim 1, wherein each of the plurality of sub-pixels further includes a sensing transistor configured to control a connection between a reference line and the second node of the driving transistor according to a sensing signal supplied through a sensing signal line, and the sensing signal applied to the sensing signal line has the same signal waveform as the scan signal applied to the scan signal line.

9. The display device of claim 1, wherein the turn-on level voltage period of each of the plurality of scan signals is greater than one horizontal time.

10. The display device of claim 9, wherein the turn-on level voltage period of each of the plurality of scan signals is greater than or equal to four horizontal times.

11. A driving circuit that drives a display panel including a plurality of sub-pixels connected to a plurality of data lines, a first fake data line and a plurality of scan signal lines, wherein each of the plurality of sub-pixels includes a light-emitting element, a driving transistor configured to drive the light-emitting element, a scan transistor configured to control a connection between a corresponding data line of the plurality of data lines and a first node of the driving transistor according to a scan signal supplied through the scan signal line, and a capacitor connected between the first node and a second node of the driving transistor, the driving circuit comprising:

a data driving circuit configured to supply an image data voltage for displaying a real image to a first sub-pixel among the plurality of sub-pixels through a first data line of the plurality of data lines during a first driving period; and a fake data driving circuit configured to supply a fake data voltage for displaying a fake image different from the real image to second sub-pixels different from the first sub-pixel among the plurality of sub-pixels through the first fake data line during the first driving period, wherein the second sub-pixels include a sub-pixel connected to the first data line.

12. The driving circuit of claim 11, wherein the fake image is a black image, a low grayscale image, or a monochrome image.

13. A display device comprising:

a display panel including a plurality of sub-pixels, a plurality of data lines, a first fake data line and a plurality of scan signal lines;

a data driving circuit configured to drive the plurality of data lines and the first fake data line; and a gate driving circuit configured to drive the plurality of scan signal lines, wherein each of the plurality of sub-pixels includes a light-emitting element, a driving transistor configured to drive the light-emitting element, and a scan transistor electrically connected to a first node of the driving transistor, wherein the plurality of sub-pixels include a first sub-pixel and a second sub-pixel and the plurality of data lines includes a first data line and a second data line, wherein the first data line is electrically connected to the first sub-pixel, wherein the second data line is electrically connected to the second sub-pixel, and wherein the first fake data line is electrically connected to the first sub-pixel and the second sub-pixel.

14. The display device of claim 13, wherein the display panel further comprises a fake switching transistor, wherein the first fake date line is electrically connected to the fake switching transistor, wherein the first fake switching transistor is electrically connected to a first node of the driving transistor of the first sub-pixel and a first node of the driving transistor of the second sub-pixel.

15. The display device of claim 14, wherein when the driving circuit is configured to supply an image data voltage for displaying a real image to the first sub-pixel or the second sub-pixel, the first fake switching transistor is turned off.

16. The display device of claim 14, wherein when the driving circuit is configured to supply a fake data voltage for displaying a fake image different from a real to the first sub-pixel and the second sub-pixel, the first fake switching transistor is turned on.

17. The display device of claim 13, wherein the driving circuit is configured to supply a fake data voltage which is a black data voltage, a low grayscale data voltage, or a monochrome data voltage.

18. The display device of claim 13, wherein the gate driving circuit is configured to sequentially supply a plurality of scan signals sequentially having a turn-on level voltage period, to the plurality of scan signal lines, and corresponding turn-on level voltage periods of scan signals applied to two adjacent scan signal lines among the plurality of scan signal lines partially overlap.

19. The display device of claim 13, wherein the display panel further comprises a first fake switching transistor, a second fake switching transistor, a third sub-pixel and a fourth sub-pixel, wherein the first fake date line is electrically connected to the fake switching transistor and the second fake switching transistor, wherein the first fake switching transistor is electrically connected to the first sub-pixel and the second sub-pixel, wherein the second fake switching transistor is electrically connected to the third sub-pixel and the fourth sub-pixel.

20. The display device of claim 19, wherein when the driving circuit is configured to supply an image data voltage to the first sub-pixel or the second sub-pixel, a fake data voltage is simultaneously supplied to the third sub-pixel or the fourth sub-pixel.

* * * * *